US009865191B2

(12) United States Patent
Yata et al.

(10) Patent No.: US 9,865,191 B2
(45) Date of Patent: Jan. 9, 2018

(54) IMAGE PROCESSING DEVICE, DISPLAY DEVICE, ELECTRONIC DEVICE AND METHOD FOR PROCESSING AN IMAGE

(71) Applicant: Japan Display Inc., Tokyo (JP)

(72) Inventors: Tatsuya Yata, Tokyo (JP); Takayuki Nakanishi, Tokyo (JP)

(73) Assignee: Japan Display Inc., Tokyo (JP)

( * ) Notice: Subject to any disclaimer, the term of this patent is extended or adjusted under 35 U.S.C. 154(b) by 353 days.

(21) Appl. No.: 14/518,649

(22) Filed: Oct. 20, 2014

(65) Prior Publication Data

US 2015/0109356 A1 Apr. 23, 2015

(30) Foreign Application Priority Data

Oct. 22, 2013 (JP) ..... 2013-219699
Oct. 17, 2014 (JP) ..... 2014-213105

(51) Int. Cl.
*G09G 3/20* (2006.01)
*G09G 3/3225* (2016.01)

(52) U.S. Cl.
CPC ..... *G09G 3/2003* (2013.01); *G09G 3/3225* (2013.01); *G09G 2300/0452* (2013.01); (Continued)

(58) Field of Classification Search
CPC ..... G09G 3/2003; G09G 3/3225; G09G 2320/0626; G09G 2320/0666; G09G 2340/06; G09G 2360/16; G09G 2300/0452
See application file for complete search history.

(56) References Cited

U.S. PATENT DOCUMENTS 6,778,183 B1 8/2004 Nair et al.
6,885,380 B1 4/2005 Primerano et al.
(Continued)

FOREIGN PATENT DOCUMENTS

JP 2007-514184 A 5/2007
JP 2009-192887 A 8/2009
(Continued)

OTHER PUBLICATIONS

Korean Office Action dated Jul. 13, 2015 for corresponding Korean Application No. 10-2014-0143136.

*Primary Examiner* — Amr Awad
*Assistant Examiner* — Andre Matthews
(74) *Attorney, Agent, or Firm* — Michael Best & Friedrich LLP

(57) ABSTRACT

An image processing device comprising: a conversion unit to receive a first input signal including first color information, a first color being reproduced at pixels on the basis of the first color information, the first input signal including first color information obtained from an input image signal corresponding to a red component, a green component and a blue component, to specify saturation of the first color, and configured to obtain luminance attenuation ratio on the basis of a relationship previously stored between saturation and luminance attenuation ratio, and the saturation of the first color, and to output a second input signal including second color information whose luminance is decreased from the first color information on the basis of the luminance attenuation ratio corresponding to the first color information; and a signal processing unit configured to output an output signal for driving the pixels on the basis of the second input signal.

11 Claims, 21 Drawing Sheets

(52) U.S. Cl.
CPC ..... *G09G 2320/0626* (2013.01); *G09G 2320/0666* (2013.01); *G09G 2330/021* (2013.01); *G09G 2340/06* (2013.01); *G09G 2360/16* (2013.01)

(56) References Cited

U.S. PATENT DOCUMENTS

| | | | |
|---|---|---|---|
| 6,897,876 | B2 | 5/2005 | Murdoch et al. |
| 6,903,378 | B2 | 6/2005 | Cok |
| 7,012,588 | B2 | 3/2006 | Siwinski |
| 7,091,941 | B2 | 8/2006 | Arnold et al. |
| 7,151,517 | B2 | 12/2006 | Lee |
| 7,982,693 | B2 | 7/2011 | Mizukoski et al. |
| 8,094,933 | B2 | 1/2012 | Cok et al. |
| 8,184,112 | B2 | 5/2012 | Miller et al. |
| 8,203,572 | B2 | 6/2012 | Park et al. |
| 8,232,944 | B2 | 7/2012 | Takada et al. |
| 8,299,985 | B2 | 10/2012 | Shin et al. |
| 8,362,981 | B2 | 1/2013 | Mizukoshi et al. |
| 8,681,190 | B2 | 3/2014 | Yano et al. |
| 2004/0178973 | A1 | 9/2004 | Miller et al. |
| 2004/0222999 | A1 | 11/2004 | Choi et al. |
| 2010/0259685 | A1* | 10/2010 | Isobe ..... H04N 9/67 348/645 |
| 2011/0013041 | A1* | 1/2011 | Abe ..... G06T 5/009 348/222.1 |
| 2011/0181633 | A1* | 7/2011 | Higashi ..... G09G 3/2003 345/691 |
| 2012/0236016 | A1 | 9/2012 | Fujino |

FOREIGN PATENT DOCUMENTS

| | | | |
|---|---|---|---|
| JP | 2010-072353 | A | 4/2010 |
| JP | 4494808 | B2 | 4/2010 |
| JP | 2010-211098 | A | 9/2010 |
| JP | 2011-100144 | A | 5/2011 |
| JP | 2011-164137 | A | 8/2011 |
| JP | 2011-221112 | A | 11/2011 |
| JP | 2012-027397 | | 2/2012 |
| JP | 2012-194256 | A | 10/2012 |
| JP | 2012-248911 | A | 12/2012 |
| JP | 2013-182149 | A | 9/2013 |
| KR | 1020070116618 | A | 12/2007 |
| WO | WO-2006/108083 | A2 | 10/2006 |

* cited by examiner

IMAGE PROCESSING DEVICE, DISPLAY DEVICE, ELECTRONIC DEVICE AND METHOD FOR PROCESSING AN IMAGE

CROSS-REFERENCE TO RELATED APPLICATIONS

The present application claims priority to and incorporates by reference the entire contents of Japanese Patent Application No. 2013-219699 filed in Japan on Oct. 22, 2013, and Japanese Patent Application No. 2014-213105 filed in Japan on Oct. 17, 2014.

BACKGROUND OF THE INVENTION

1. Field of the Invention

The present invention relates to an image processing device, a display device, an electronic device and a method for processing an image.

2. Description of the Related Art

Conventionally, the display device provided with an image display panel lighting the self-emitting elements like Organic Light Emitting Diode (OLED) needs no back light. Amount of power depends on the number of the self-emitting element in each of pixels. Therefore, it is effective for saving power consumption to reduce lighting of the self-emitting element by decreasing luminance of the self-emitting element. For example, Japanese patent laying open publication No. 2010-211098, which is entirely incorporated herein as a reference, describes an invention of decreasing luminance when saturation of the display image color is high in order to suppress power consumption.

In the invention described in the reference, luminance of one image frame is evenly decreased when a rate of the number of pixels whose saturation is high is beyond a predetermined threshold. In this case, it leads a degradation of the display image due to low luminance of a whole image or change of impression of a viewer.

In light of the foregoing, it is desirable to provide an image processing device, a display device, an electronic device and a method of image processing capable of reducing the power consumption by decreasing luminance while suppressing the degradation of the display image.

SUMMARY OF THE INVENTION

According to an aspect of the invention, an image processing device is provided. The image processing device includes a conversion unit to receive a first input signal including first color information, a first color being reproduced at pixels on the basis of the first color information, the first input signal including first color information obtained from an input image signal corresponding to a red component, a green component and a blue component, to specify saturation of the first color, and configured to obtain luminance attenuation ratio on the basis of a relationship previously stored between saturation and luminance attenuation ratio, and the saturation of the first color, and to output a second input signal including second color information whose luminance is decreased from the first color information on the basis of the luminance attenuation ratio corresponding to the first color information; and a signal processing unit configured to output an output signal for driving the pixels on the basis of the second input signal.

According to the invention, the luminance is decreased based on the relation between saturation and the luminance attenuation ratio. It enables to control the change of impression of a viewer to the display image in the human sense against colors. According to this invention, it enables to reduce the power consumption by decreasing luminance in the range without degrading the display image.

According to another aspect of the invention, a display device is provided. The display device includes: an image display portion including a plurality of pixels, each of pixels including: a first sub-pixel for displaying a red component according to an amount of lighting of a self-emitting element; a second sub-pixel for displaying a green component according to an amount of lighting of a self-emitting element; a third sub-pixel for displaying blue color component according to an amount of lighting of a self-emitting element; and a forth sub-pixel for displaying additional color component according to an amount of lighting of a self-emitting element, at least one of luminance and a color display power efficiency of the additional color component is higher than that of a color component represented by the red component, the green component, and the blue component, and the additional color component being different from the red component, the green component, or the blue component; and the image processing device described above.

According to another aspect of the invention, an electronic device is provided. The electronic device includes: the display device described above; and a controller to control the display device.

According to another aspect of the invention, a method for processing an image is provided. The method for processing an image includes the conversion process which includes receiving a first input signal including first color information, a first color being reproduced at pixels on the basis of the first color information, the first input signal including first color information obtained from an input image signal corresponding to a red component, a green component, a blue component; specifying saturation of the first color; obtaining luminance attenuation ratio on the basis of a relationship previously stored between saturation and luminance attenuation ratio, and the saturation of the first color;—outputting a second input signal including second color information whose luminance is decreased from the first color information on the basis of the luminance attenuation ratio corresponding to the first color information; and the signal processing process which includes outputting an output signal for driving the pixels on the basis of the second input signal.

DETAILED DESCRIPTION OF THE PREFERRED EMBODIMENTS

Exemplary embodiments for implementing the present disclosure will be explained in detail below with reference to the accompanying drawings. It should be noted that the drawings do not limit any dimensions of each of components of the embodiments of the present invention, that is, the drawings are illustrative only. The present disclosure is not limited by the contents described in the following embodiments. In addition, the components described as follows include those which can be easily conceived by persons skilled in the art and those which are substantially equivalent thereto. Moreover, the components described as follows can be arbitrarily combined with each other.

[First Embodiment]

A first embodiment is explained in detail below with reference to the accompanying drawings.

<Configuration of Display Device>

Figure 1:
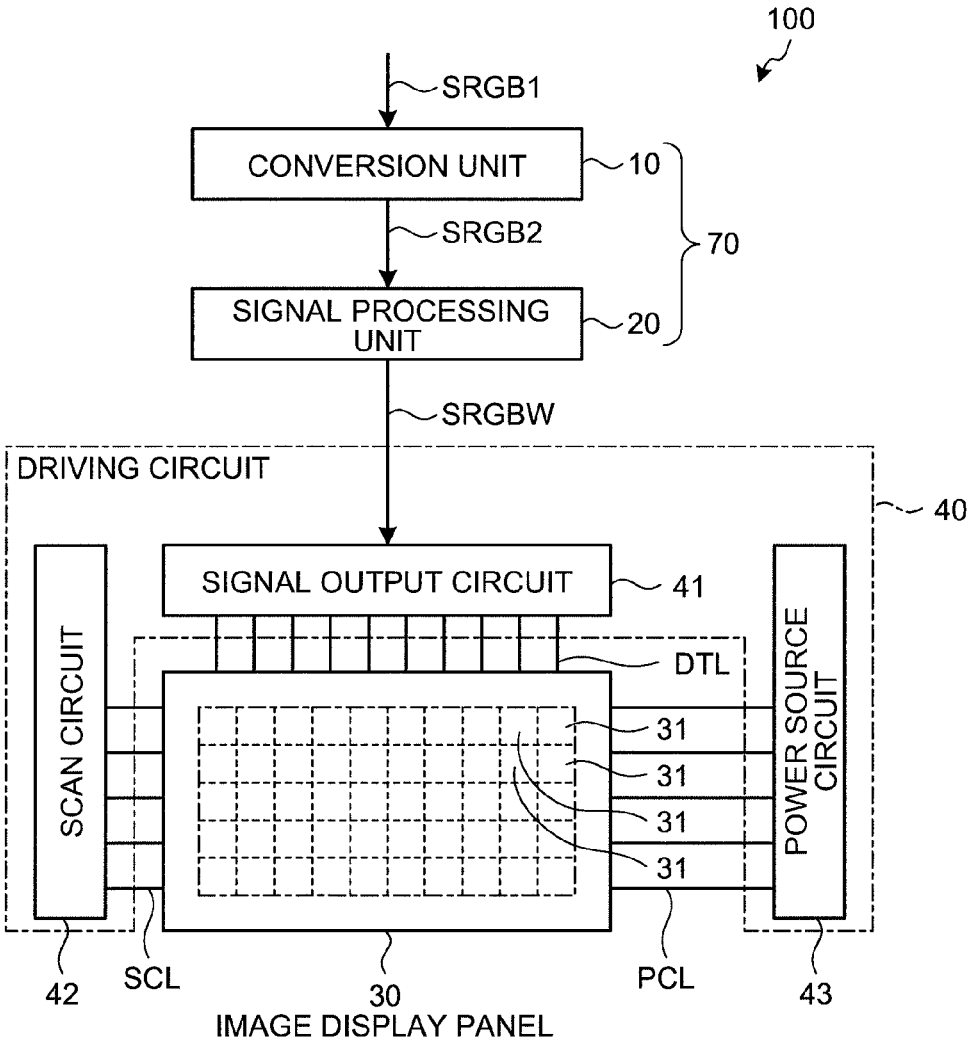
FIG. 1 is a schematic block diagram illustrating a configuration of the display device according to an embodiment.
Figure 2:
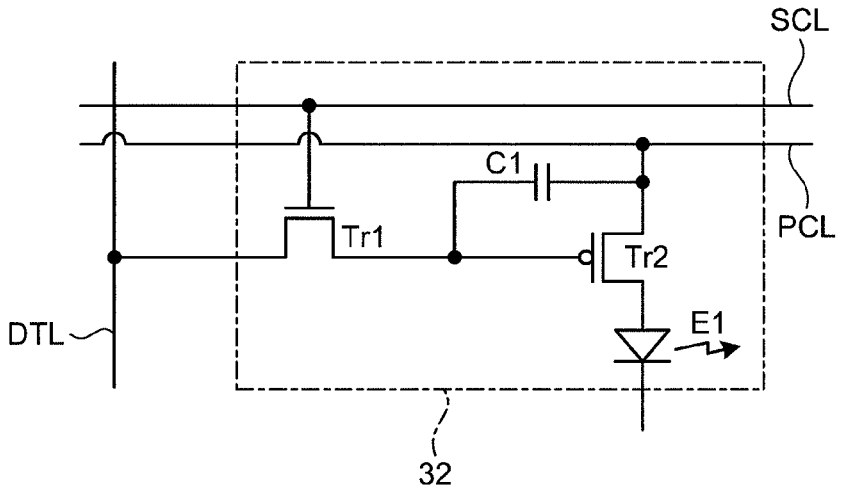
FIG. 2 is an exemplary diagram of a lighting drive circuit of a pixel including sub-pixels of an image display portion according to the embodiment.
Figure 3:
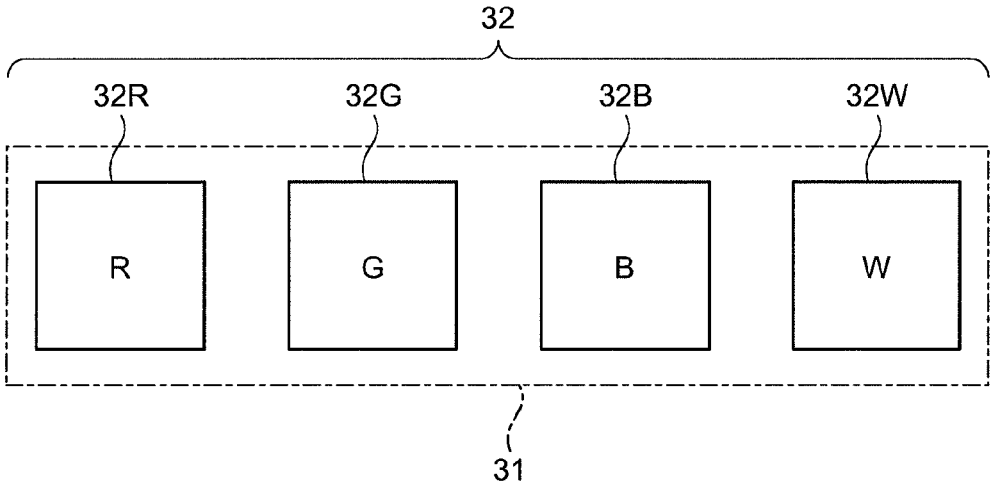
FIG. 3 is an exemplary diagram of arrangement of sub-pixels of the image display portion according to the embodiment.
Figure 4:
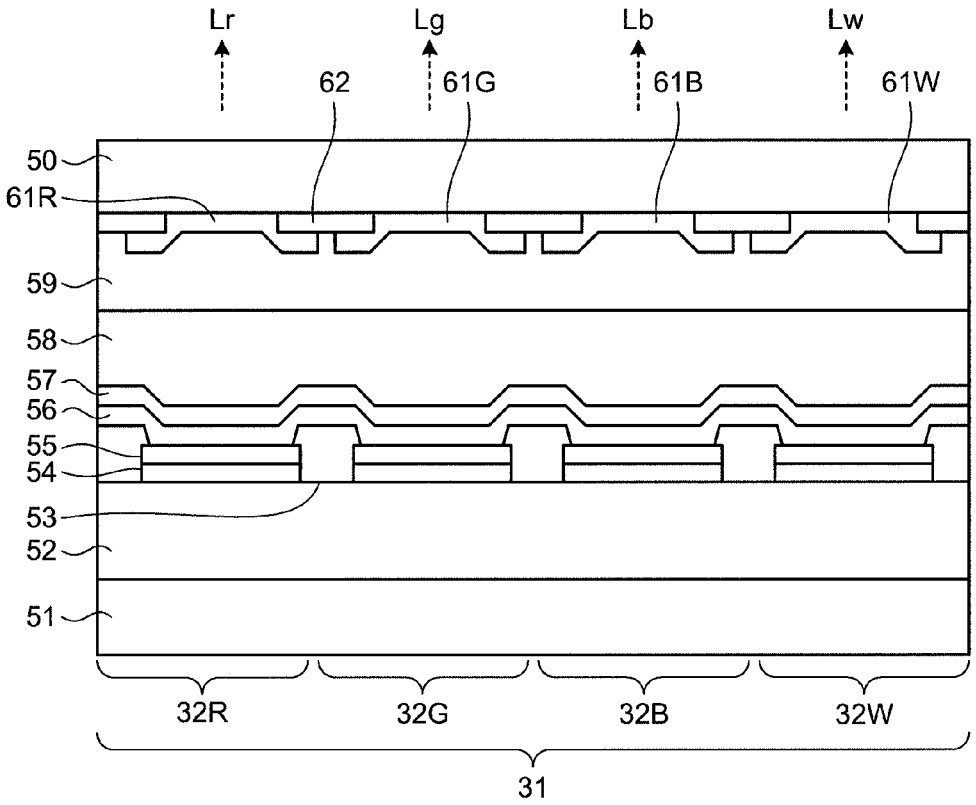
FIG. 4 is a cross-sectional view of the image display portion according to the embodiment.

FIG. 1 is a schematic block diagram illustrating a configuration of the display device according to an embodiment. FIG. 2 is an exemplary diagram of a lighting drive circuit of a pixel including sub-pixels of an image display portion according to the embodiment. FIG. 3 is an exemplary diagram of arrangement of sub-pixels of the image display portion according to the embodiment. FIG. 4 is a cross-sectional view of the image display portion according to the embodiment.

As illustrated in FIG. 1, a display device 100 includes an image processing unit 70, an image display portion (image display panel) 30, an image display panel driving circuit 40 (hereinafter, referred to a driving circuit 40 as well) for controlling a drive of the image display panel 30. The image processing unit 70 includes a conversion unit 10 and a signal processing unit 20. The conversion unit 10 and the signal processing unit 20 may be, but not limited to, realized with hardware and/or software. In a case where circuits of each the conversion unit 10 and the signal processing unit 20 are configured by the hardware, it is not necessary to be physically isolated each other. A plurality of functions thereof may be realized as a single circuit integrally fabricated.

The conversion unit 10 receives a first input signal SRGB 1 including first color information from which a first color is reproduced at a predetermined pixel which is obtained from the input image signal. The conversion unit 10 outputs a second input signal SRGB 2. Here, the second input signal SRGB 2 is a signal which includes second color information whose luminance is decreased in luminance attenuation ratio within a predetermined range defined as a range in which a variation of the luminance is allowable by a human being. The second color information is converted from the first color information as an input value of an HSV color space. Each of the first color information and the second color information may be three colors input signal (R, G, B) including a red component (R), a green component (G), and a blue component (B). Furthermore, the conversion unit 10 may store a look-up table indicating a relationship between saturation and luminance attenuation ratio. Relationship between saturation and luminance attenuation ratio is to be described below.

The signal processing unit 20 is connected to an image display panel driving circuit 40 to drive the image display panel 30. For example, the signal processing unit 20 converts an input value of an input signal into the HSV color space (the second input signal SRGB 2) into a color-reproduction value in the HSV color space which is reproduced with a first color, second color, third color and the forth color to generate an output signal (a output signal SRGBW), and outputs the generated output signal to the image display panel 30. The signal processing unit 20 can output to the driving circuit 40 the output signal SRGBW including third color information which is converted to, for example, the red component (R), the green component (G), the blue component (B) and white component (W) based on the second color information in the second input signal SRGB 2. The third color information may be four colors input signal (R, G, B, W). Although in the following description it is assumed that the additional color component is pure white that includes 256 gradations of each of the red component (R), the green component (G) and the blue component (B), i.e., (R, G, B)=(255, 255, 255), it is not limited thereto. For example, the additional color component may be forth sub-pixel to be converted that includes gradations of (R, G, B)=(255, 230, 204).

In the embodiment, as mentioned above, converting process that converts the input signal (for instance, RGB) to the HSV color space is exemplary explained. However, it is not limited thereto. For example, the converting process may be performed in XYZ space, YUV space and other coordinate system. In the embodiment, color gamut of sRGB or Adobe™ is represented as an area of triangle shape in the x-y chromaticity range of XYZ color system. However, it is not limited thereto. For example, the color space in which color gamut is defined may be an area surrounded by a polygon boundary.

The signal processing unit 20 outputs the generated output signal to the image display panel driving circuit 40. The driving circuit 40 includes a signal output circuit 41, a scanning circuit 42 and a power source circuit 43, to control the image display panel 30. The driving circuit 40 of the image display panel 30 holds the output signal SRGBW including third color information with the signal output circuit 41, and outputs the signal to each of pixels 31 in order. The signal output circuit 41 is electrically connected to the image display panel 30 via a signal line DTL. The driving circuit 40 of the image display panel 30 selects a sub-pixel in the image display panel 30 with the scanning circuit 42 and controls turn-on and/or turn-off of a switching element (such as a Thin Film Transistor (TFT)) to control operation of the sub-pixel (for example, light transmission rate). The scanning circuit 42 is electrically connected to the image display panel 30 via a scanning line SCL. The power source circuit 43 supplies electrical power to a self-emitting element of each of pixels 31, which is described below, via a scanning line PCL.

An example of the display device 100 is disclosed in Japanese Patent Publication No. 3,167,026, Japanese Patent Publication No. 3,805,150, Japanese Patent Publication No. 4,870,358, Japanese Patent Laying-open Publication No. 2011-90118, and Japanese Patent Laying-open Publication No. 2006-3475, which are entirely incorporated herein as references.

As illustrated in FIG. 1, a plurality of pixels 31 are arranged on the image display panel 30 in a manner of 2-dimension matrix ($P_0 \times Q_0$, where $P_0$ pixels being along a row direction and $Q_0$ pixels being along a column direction).

Each of the pixels 31 includes a plurality of sub-pixels. As illustrated in FIG. 2, lighting drive circuits of the sub-pixel 32 are arranged in a manner of 2-dimensional matrix. The lighting drive circuit includes a controlling transistor Tr1, a driving transistor Tr2, and a charge holding capacitor C1. A gate, a source and a drain of the controlling transistor Tr1 are connected to the scanning line SCL, the signal line DTL, and a gate of driving transistor Tr2, respectively. One terminal of the charge holding capacitor C1 is connected to a gate of the driving transistor Tr2, the other end of the charge holding capacitor C1 is connected to a source of the driving transistor Tr2. The source of the driving transistor Tr2 is connected to the power line PCL. A drain of the driving transistor Tr2 is connected to an anode of an organic light emitting diode E1 as a self-emitting element. A cathode of the organic light emitting diode E1 is, for example, connected to a reference voltage (for example, the ground potential). Although FIG. 2 describes the example that the controlling transistor Tr1 is n-channel transistor and the driving transistor Tr2 is p-channel transistor, polarity of each transistor is not limited thereto. Polarity of the controlling transistor Tr1 and the driving transistor Tr2 may be chosen as necessary.

As illustrated in FIG. 3, the pixel 31 includes, for example, a first sub-pixel 32R, a second sub-pixel 32G, a third sub-pixel 32B, and a forth sub-pixel 32W. The first sub-pixel 32R displays a first primary color (for example, a red color (R) component). The second sub-pixel 32G displays a second primary color (for example, a green color (G) component). The third sub-pixel 32B displays a third primary color (for example, a blue color (B) component). The fourth sub-pixel 32W displays a forth color (specifically in this embodiment, white color) as an additional color component distinct from the primary colors. In the following, the first sub-pixel 32R, the second sub-pixel 32G, the third sub-pixel 32B, and the forth sub-pixel 32W may be referred to as a sub-pixel 32 if necessary.

As illustrated in FIG. 4, the image display panel 30 includes a first substrate 51, insulating layers 52, 53, a reflecting layer 54, a lower electrode 55, a self-emitting layer 56, an upper electrode 57, insulating layers 58, 59, color filters 61R, 61G, 61B, 61W as color converting layers, a black matrix 62 as a shading layer, and a second substrate 50. The first substrate 51 is made of semiconductor material such as silicon, glass material, resin material or the like. The above mentioned lighting drive circuit and so on may be formed and/or mounted on the first substrate 51. The insulating layer 52 functions as a protecting layer to protect the lighting drive circuit and so on from the environment, and is made of silicon oxide or silicon nitride. The lower electrode 55 to be the anode of the organic light emitting diode E1 is provided at each of regions of the first sub-pixel 32R, the second sub-pixel 32G, the third sub-pixel 32B, and the forth sub-pixel 32W. The lower electrode 55 is made of conductive material. The lower electrode 55 is transparent electrode made of transparent conductive material such as Indium Tin Oxide (ITO) and the like. The insulating layer 53 called as a bank which defines boundaries of the first sub-pixel 32R, the second sub-pixel 32G, the third sub-pixel 32B, and the forth sub-pixel 32W. The reflecting layer 54 is made of a glossy metal material, for example, silver, aluminum, gold or the like, which can reflect a light irradiated from the self-emitting layer 56. The self-emitting layer 56 includes organic material that configures a hole injection layer, a hole transport layer, a light emitting layer, an electron transport layer and an electron injection layer (not shown).

[Hole Transport Layer]

As the hole transport layer, it is preferable to employ a layer which includes aromatic amine compound and substance indicating electron acceptability thereto. The aromatic amine compound means a substance having arylamine skeleton. Among the aromatic amine compound, in particular, the aromatic amine compound including triphenylamine skeleton and whose molecular weight is equal to and greater than 400 is preferable. Among the aromatic amine compound including triphenylamine skeleton, in particular, the aromatic amine compound including triphenylamine skeleton that includes a condensed aromatic ring such as naphthyl ring is preferable. Use of the aromatic amine compound including the triphenylamine together with the condensed aromatic ring in Skelton results in improving in heat resistance properties of the LED. Specifically, not being limited to, the aromatic amine compound may include 4-4'-bis[N-(1-naphthyl)-N-phenylamino]biphenyl (i.e., α-NPD), 4-4'-bis[N-(3-methylphenyl)-N-phenylamino]biphenyl (i.e., TPD), 4,4',4"-tris(N, N-diphenylamino)triphenylamine (i.e., TDATA), 4,4',4"-tris[N-(3-methylphenyl)-N-phenylamino) triphenylamine (i.e., MTDATA), 4-4'-bis[N-{4-(N, N-di-m-tolylamino)phenyl}-N-phenylamino] biphenyl (i.e., DNTPD), 1,3,5-tris[N, N-di(m-tolyl)-animo] benzene (i.e., m-MTDAB), 4,4',4"-tris(N-carbazolyl) triphenylamine (i.e., TCTA), 2-3-bis(4-diphenylaminophenyl) quinoxaline (i.e., TPAQn), 2, 2',3,3"-tetrakis(4-diphenylaminophenyl)-6,6'-bisquinoxaline (i.e., D-TriPhAQn), 2-3-bis{4-[N-(1-naphthyl)-N-phenylamino] phenyl}-dibenzo[f, h] quinoxaline (i.e., NPADiBzQn), and the like. The substance indicating electron acceptability to the aromatic amine compound, not being limited to, may include molybdenum oxide, vanadium oxide, 7,7,8,8-tetracyanoquinodimethane (TCNQ), 2,3,5,6-tetrafluoro-7,7,8,8-tetracyanoquinodimethane (F4-TCNQ) and the like.

[Electron Injection Layer and Electron Transport Layer]

The electron injection layer, not being limited to, may be made of among metal complex compound such as: tris(8-hydroxyquinolinato)aluminum (i.e., $Alq_3$), tris(4-methyl-8-hydroxyquinolinato)aluminum (i.e., $Almq_3$), bis(10-hydroxybenzo[h]-quinolinato)beryllium (i.e., $BeBq_2$), bis(2-methyl-8-hydroxyquinolinato)-4-phenylphenolato-alminium (i.e., BAlq), bis[2-(2-hydroxyphenyl) benzoxazolato]zinc ($Zn(BOX)_2$), bis[2-(2-hydroxyphenyl) benzothiazolate]zinc ($Zn(BTZ)_2$), and the like, as well as 2-(4-biphenyl)-5-(4-tert-butylphenyl)-1,3,4-oxydiazole (i.e., PBD), 1,3-bis[5-(p-tert-butylphenyl)-1,3,4-oxydiazole-2-yl] benzene (i.e., OXD-7), 3-(4-tert-butylphenyl)-4-phenyl-5-(4-biphenylyl)-1,2,4-tri azole (i.e., TAZ), 3-(4-tert-butylphenyl)-4-(4-ethylphenyl)-5-(4-biphenylyl)-1,2,4-triazole (i.e., p-EtTAZ), bathophenanthroline (i.e., BPhen), bathocuproin (i.e., BCP) and the like. The substance indicating electron-donating ability to the electron transport layer may be made of, but not limited to, alkali metal such as lithium, cesium and the like, alkali earth metal such as magnesium, calcium and the like, as well as rare earth metal such as erbium, ytterbium and the like. Alternatively, the substance indicating electron-donating ability to the electron transport layer may be made of alkali metal oxide such as lithium oxide ($Li_2O$) or alkali earth metal oxide such as calcium oxide (CaO), sodium oxide ($Na_2O$), potassium oxide ($K_2O$), magnesium oxide (MgO) and the like.

<Light Emitting Layer>

Light emitting layer may be made of luminous substance emitting red light whose spectrum peak is from 600 nm to 680 nm. For example, such a substance emitting red light, but not limited to, may include:

4-dicyanomethylene-2-isopropyl-6-[2-(1,1,7,7-tetramethyl-julolidine-9-yl)ethenyl]-4H-pyran (i.e., DCJTI), 4-dicyanomethylene-2-methyl-6-[2-(1,1,7,7-tetramethyl-julolidine-9-yl)ethenyl]-4H-pyran (i.e., DCJT), 4-dicyanomethylene-2-tert-butyl-6-[2-(1,1,7,7-tetramethyl-julolidine-9-yl)ethenyl]-4H-pyran (i.e., DCJTB), periflanthene, 2,5-dicyano-1,4-bis[2-(10-methoxy-1,1,7,7-tetramethyl-julolidine-9-yl)ethenyl]benzene and the like. Light emitting layer may be made of luminous substance emitting green light whose spectrum peak is from 500 nm to 550 nm. For example, such a substance emitting green light, but not limited to, may include: N,N'-dimethylquinacridone (DMQd), coumalin6, coumalin545T, tris(8-hydroxyquinolinato)aluminium (i.e., $Alq_3$) and the like. Light emitting layer may be made of luminous substance emitting blue light whose spectrum peak is from 420 nm to 500 nm. For example, such a substance emitting blue light, but not limited to, may include:

9,10-bis(2-naphthyl)-tert-butylanthracene (i.e., t-BuDNA), 9,9'-bianthryl, 9,10-diphenylanthracene (i.e., DPA), 9,10-bis(2-naphthyl)anthracene (i.e., DNA), bis(2-methyl-8-hydroxyquinolinato)-4-phenylphenolato-gallium (i.e., BGaq), bis(2-methyl-8-hydroxyquinolinato)-4-phenylphenolato-aluminium (i.e., BAlq) and the like. Substance emitting phosphorescence may be employed other than the substance emitting fluorescence. For example, such a substance emitting phosphorescence, but not limited to, may include:

bis[2-(3,5-bis(trifluoromethyl)phenyl)pyridinato-N,C2'] iridium (III)picolinate (i.e., $Ir(CF_3ppy)_2(pic)$), bis[2-(4,6-difluorophenyl)pyridinato-N,C2']iridium (III) acetylacetonate (i.e., FIr(acac)), bis[2-(4,6-difluorophenyl)pyridinato-N,C2']iridium (III) picolinate (i.e., FIr(pic)), tris(2-phenylpyridinato-N,C2')iridium (i.e., Ir(ppy)3) and the like.

The upper electrode 57 is a transparent electrode made of transparent conductive material such as Indium Tin Oxide (ITO) and the like. The transparent conductive material of the transparent electrode is not limited to the ITO. For example, Indium Zinc Oxide (IZO) may be used instead of the ITO. Alternatively, transparent conductive material having composition other than ITO and IZO may be used. The upper electrode 57 is to be the cathode of the organic light emitting diode E1. The insulating layer 58, which is made of silicon oxide, silicon nitride or the like, seals out the above mentioned upper electrode 57. The insulating layer 59, which is made of silicon oxide, silicon nitride or the like, planarises steps formed by the bank.

The second substrate 50, which is made of transparent material such as glass for example, protects a surface of the image display panel 30 entirely.

In FIG. 4, although the lower electrode 55 and the upper electrode 57 are anode and cathode, respectively, the embodiment is not limited thereto. The lower electrode 55 and the upper electrode 57 may be cathode and anode, respectively. In such a case, it is possible to alter the channel type of the driving transistor Tr2 electrically connected to the lower electrode 55, when appropriate. It is also possible to alter the stacking order of the carrier injection layer (the hole injection layer and the electron injection layer), the carrier transport layer (the hole transport layer and the electron transport layer), and the light emitting layer, when appropriate.

The image display panel 30 may be a color display panel. As illustrated in FIG. 4, a first color filter 61R is located between the first sub-pixel 32R and a user who views an image such that only the first primary color component Lr among primary color components of the self-emitting layer 56 can pass therethrough. A second color filter 61G is located between the second sub-pixel 32G and the user such that only the second primary color component Lg among the primary color components of the self-emitting layer 56 can pass therethrough. A third color filter 61B is located between the third sub-pixel 32B and the user such that only the third primary color component Lb among the primary color components of the self-emitting layer 56 can pass therethrough. A forth color filter 61W is located between the forth sub-pixel 32W and the user such that only the fourth color component Lw that has been previously manipulated can pass therethrough. The image display panel 30 may emit the forth color component Lw from the forth sub-pixel 32W, which is distinct from the first primary color component Lr, the second primary color component Lg, or the third primary color component Lb. Without providing the color converting layers like color filter, the image display panel 30 may emit the forth color component Lw from the forth sub-pixel 32W, which is distinct from the first primary color component Lr, the second primary color component Lg, or the third primary color component Lb. For example, a transparent resin layer may be provided instead of the forth color filter 61W, whereby no large steps can be formed.

Figure 5:
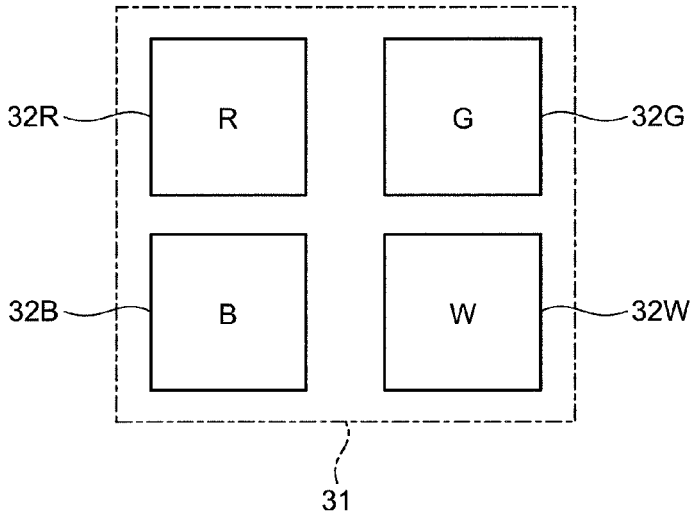
FIG. 5 is an exemplary diagram of arrangement of sub-pixels of the image display portion according to the embodiment.

FIG. 5 is an exemplary diagram of arrangement of sub-pixels of the image display portion according to the embodiment. The pixel 31, each of which has the first sub-pixel 32R, the second sub-pixel 32G, the third sub-pixel 32B and the forth sub-pixel 32W arranged in a manner of two by two, are arranged on the image display panel 30 in a manner of 2-dimension matrix.

Figure 6:
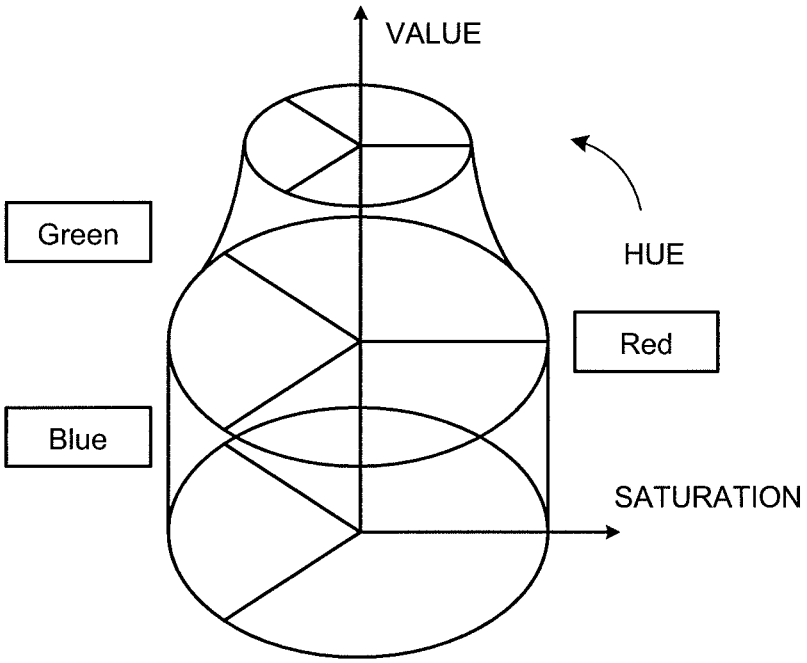
FIG. 6 is a conceptual diagram of an extended HSV color space of the display device according to the embodiment.
Figure 7:
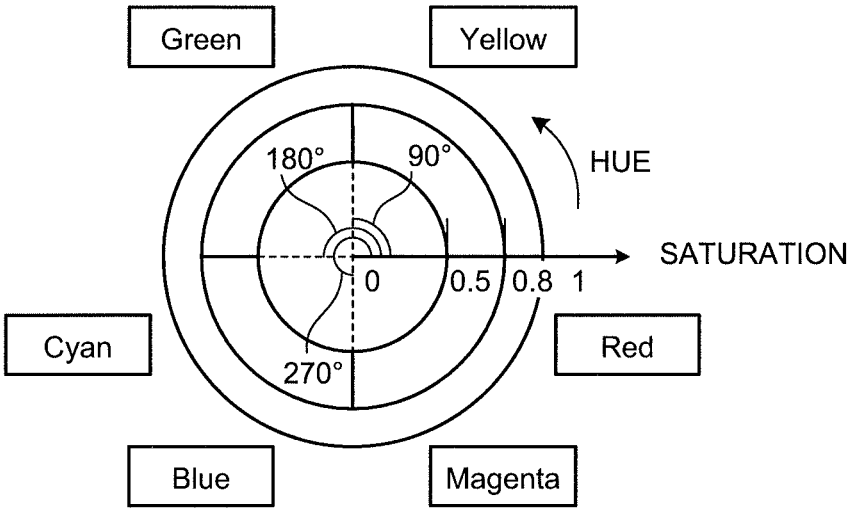
FIG. 7 is a conceptual diagram of a relationship between hue and saturation of the extended HSV color space of the display device according to the embodiment.

FIG. 6 is a conceptual diagram of an extended HSV color space of the display device according to the embodiment. FIG. 7 is a conceptual diagram of a relationship between hue and saturation of the extended HSV color space of the display device according to the embodiment. The display device 100 can expand a dynamic range of the value (also called as brightness) in the HSV color space by providing the pixel 31 with the forth sub-pixel 32W that emits the forth color (white). That is, as illustrated in FIG. 6, a substantial truncated cone portion is provided in the HSV color space, in which the greater a saturation S is, the smaller a maximum value of value V is. As a result, entire shape of the HSV color space amounts to a cylindrical portion with the substantial truncated cone portion mounted thereon. The cylindrical portion in the HSV color space is a space where the first sub-pixel 32R, the second sub-pixel 32G, and the third sub-pixel 32B can display.

The first input signal SRGB 1 includes first color information indicating gradations of each of the red color component (R), the green color component (G), and the blue color component (B). Therefore, the first input signal SRGB 1 is the color information in the range of the cylindrical portion of the HSV color space, that is, the cylindrical portion of the HSV color space in FIG. 6 comes into cylinder. In FIG. 7, the first color information is illustrated in a 2-dimentional manner.

In FIG. 7, a hue H is illustrated as an angular orientation from 0 degrees to 360 degrees. Red, Yellow, Green, Cyan, Blue, and Magenta are arranged toward greater angular orientation from 0 degrees to 360 degrees. In the embodiment, a range including zero degrees stands for a red color, a range including 120 degrees stands for a green color, and a range including 240 degrees stands for a blue color.

Figure 8A:
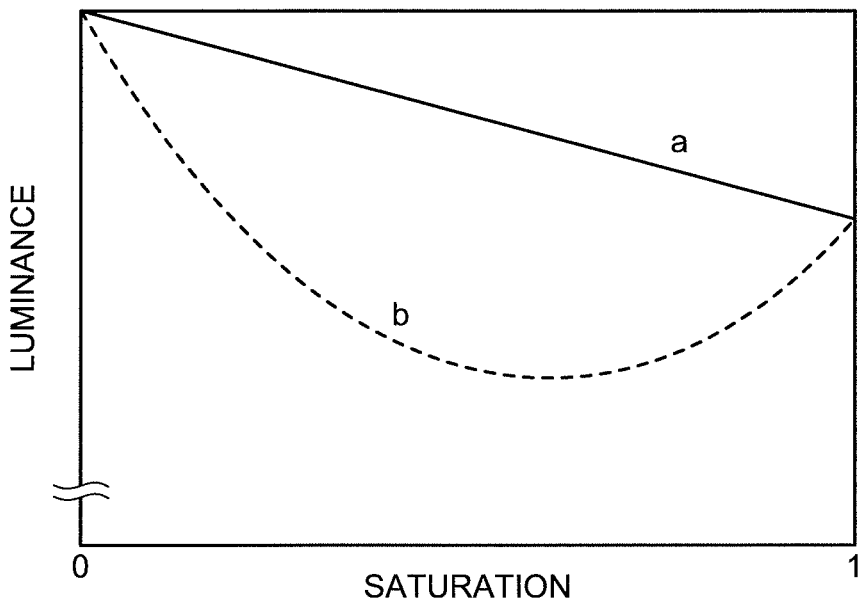
FIG. 8A is schematic diagram illustrating a relationship between saturation and luminance.
Figure 8B:
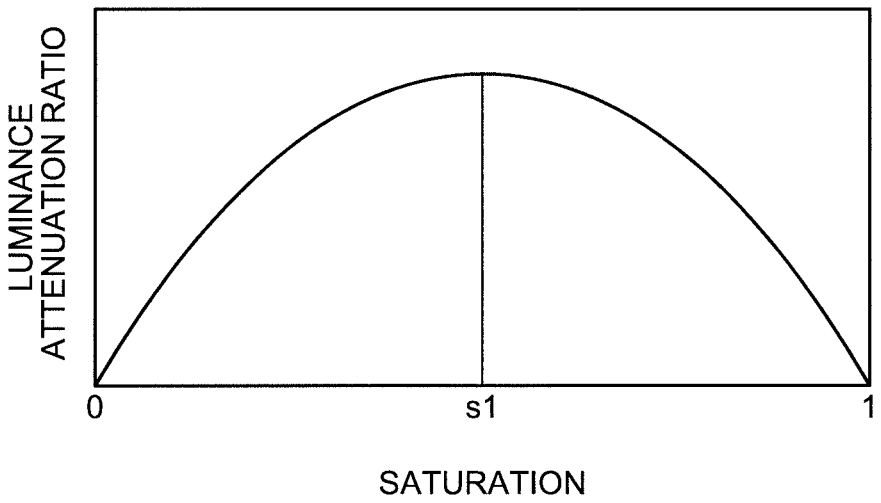
FIG. 8B is schematic diagram illustrating a relationship between saturation and luminance attenuation ratio according to a first embodiment.
Figure 9:
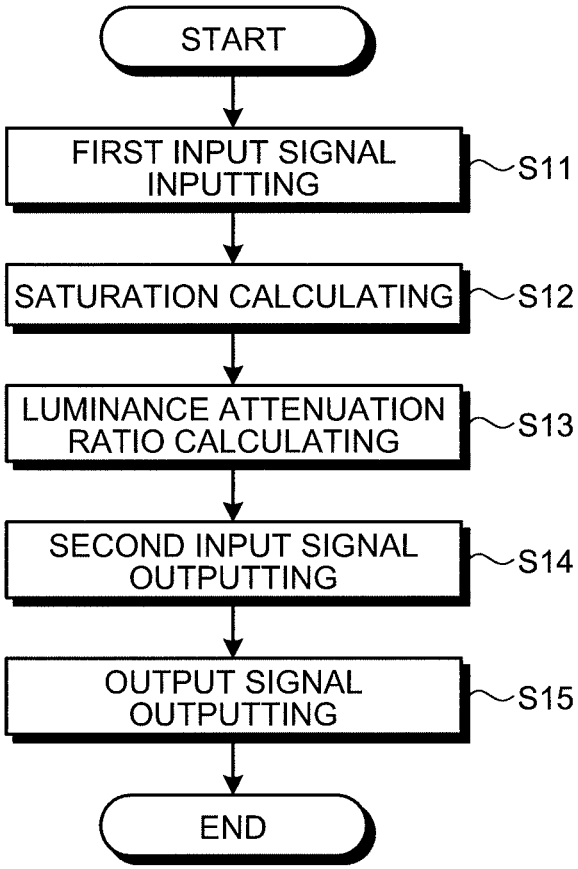
FIG. 9 is a flowchart illustrating an image processing method according to the first embodiment.

FIG. 8A is schematic diagram illustrating a relationship between saturation and luminance. FIG. 8B is schematic diagram illustrating a relationship between saturation and luminance attenuation ratio according to a first embodiment. FIG. 9 is a flowchart illustrating an image processing method according to the first embodiment. Luminance can be represented as formula (1), saturation can be represented as formula (2) as follows.

$$L=0.3R+0.6G+0.1B \qquad \text{formula (1)}$$

where L is luminance, R is gradation of a red component, G is gradation of a green component, and B is gradation of a blue component.

$$S=(\mathrm{MAX}-\mathrm{MIN})/\mathrm{MAX} \qquad \text{formula (2)}$$

where S is saturation, MAX is maximum value among R, G, and B components, and MIN is minimum value among R, G, and B components. For example, each of R, G, and B components can be represented by 256 gradations. When (R, G, B)=(200, 200, 100), L and S are calculated as 190 and 0.5, respectively. However, luminance and saturation are not limited to formula (1) and (2). For example, saturation may be represented as the following formula (3), $$S1=(\mathrm{MAX}-\mathrm{MIN}) \qquad \text{formula (3)}$$

where S1 is saturation.

In FIG. 8A, a vertical axis stands for luminance and a horizontal axis stands for saturation. In FIG. 8A, a line 'a' indicates a relationship between saturation and luminance under hue A. Here, hue A is not limited to a particular color. That is, hue A may be an arbitrary color. As illustrated in the line 'a' of FIG. 8A, luminance varies with saturation. Specifically, when saturation is relatively small, luminance is relatively high because of getting close to a white color. When saturation is relatively large, brightness is relatively low. FIG. 8B is schematic diagram illustrating a relationship between saturation and luminance attenuation ratio according to a first embodiment. In FIG. 8B, a vertical axis stands for luminance attenuation ratio and a horizontal axis stands for saturation. In FIG. 8A, a curvature 'b' indicates a relationship between saturation and luminance under hue A in a case where luminance is decreased on the basis of the relationship illustrated in FIG. 8B according to the first embodiment. Employing the relationship in FIG. 8B according to the first embodiment, as illustrated in the curvature 'b' of FIG. 8A, luminance can be decreased at a part of saturation under hue A. As a result, the display device according to the first embodiment can accomplish a significant reduction of the power consumption.

Conventionally, when luminance is down, an image displayed on the image display portion 30 looks dark. Thus, a viewer usually has different impression about the image before and after processing. However, employing the relationship between saturation and luminance attenuation ratio according to the first embodiment, the change of viewer's impression is suppressed despite of decreasing luminance at a part of saturation. Therefore, the display device according to the first embodiment can accomplish a significant reduction of the power consumption while suppressing degradation of an image. Furthermore, the display device according to the first embodiment can obtain saturation of pixels and decrease luminance thereof instead of evenly decreasing one image frame of pixels. As a result, it is possible to suppress degradation of the image even if decreasing luminance. The conversion unit 10 according to the first embodiment may store the relationship in FIG. 8B as a look-up table and perform calculation to obtain luminance attenuation ratio on the basis of the look-up table.

As illustrated in FIG. 8B, luminance attenuation ratio is equal to zero at points where saturation is zero and 1. Luminance attenuation ratio is maximum where saturation is s1.

As saturation increases from zero to s1, luminance attenuation ratio increases. As saturation increases from s1 to 1, luminance attenuation ratio decreases. A human being likely recognizes a degradation of an image when saturation is small. On the other hands, a human being unlikely recognizes degradation of an image to be displayed on the image display portion 30 when saturation is large. Therefore, the conversion unit 10 according to the first embodiment does not decrease luminance at a point where saturation is zero.

The conversion unit 10 according to the first embodiment increases luminance attenuation ratio as saturation increases from zero to S1. Therefore, the conversion unit 10 can decrease luminance appropriately while suppressing degradation of the image. To the contrary, in such a case that there is one portion whose saturation is the highest among pixels in one image frame, the portion is likely to gather attentions of a human being, and the portion is noticeable in the image. In this case, if luminance is too decreased, a human being has different impression due to high saturation of the portion before and after processing because contrast between a portion where saturation is high and another portion is conscious. The conversion unit 10 according to the first embodiment reduces luminance attenuation ratio as saturation increase from s1 to 1. Preferably, the conversion unit 10 according to the first embodiment does not decrease luminance at a point of pure color where saturation is 1 because it is remarkable at that point.

In the first embodiment, a part of a red component (R), a green component (G), and a blue component (B) is replaced with a white component to output. A white component as an additional component has greater luminance and/or power efficiency to display component than a white component represented by a red component, a green component, and a blue component. That is, in a case where power consumption of a white component is substantially equal to a sum of power consumption of a red component, green component, and a blue component, luminance of a white component is higher than that of a red component, green component, and a blue component. Furthermore, in a case where luminance of a white component is substantially equal to that of a red component, a green component, and a blue component, power consumption of a white component is less than a sum of that of a red component, green component, and a blue component. As described above, a color of an image is close to a white as saturation decreases, converting ratio into a white component comes to be greater. As a result, power consumption may be reduced. Consequently, the conversion unit 10 according to the first embodiment can preferably accomplish a significant reduction of power consumption even if luminance attenuation ratio decreases as saturation decreases because a converting ration into a white component comes to be greater.

Next, the image processing method according to the embodiment is described as follows. As illustrated in FIG. 9, in a step S11, the conversion unit 10 receives the first input signal SRGB 1 including first color information from which a first color is reproduced at a predetermined pixel of the image display portion, which is obtained from the input image signal. The first color information is, if necessary, γ-converted, so that color values in RGB system are converted into input values in the HSV color space.

Subsequently, as illustrated in FIG. 9, in step S12, the conversion unit 10 performs calculation to obtain saturation of a first color in the HSV color space based on the first color information. Subsequently, in step S13, the conversion unit 10 performs calculation to obtain luminance attenuation ratio associated with the first color information on the basis of the look-up table in FIG. 8B and the calculated saturation in step S12. Subsequently, in step S14, the conversion unit 10 performs calculation to convert the first input signal including the first color information into a second input signal SRGB2 including second color information in which luminance is decreased from the first color information on the basis of the calculated luminance attenuation ratio and outputs the second input signal to the signal processing unit 20 according to the first embodiment.

Subsequently, in step S15, the signal processing unit 20 according to the first embodiment performs to convert the second input signal into the output signal including third color information in which color components in the second color information are converted into a red component, a green component, and a blue component and a white component, and outputs the output signal to the driving circuit 40 to drive the image display portion 30.

In this way, the image processing device and the image display device according to the first embodiment can reduce power consumption while suppressing degradation of image because luminance can be decreased on the basis of the relationship between saturation and luminance attenuation ratio. Furthermore, the image processing device and the image display device according to the first embodiment can reduce power consumption by appropriately decreasing luminance within a predetermined range in which image degradation is unlikely conscious depending on the input signal.

[Modification 1]

Figure 10A:
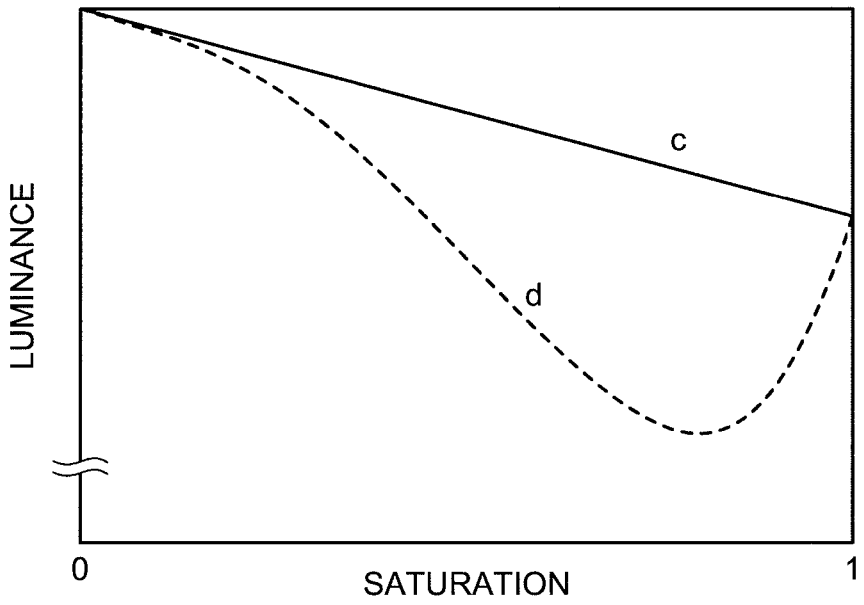
FIG. 10A is schematic diagram illustrating a relationship between saturation and luminance according to modification 1.
Figure 10B:
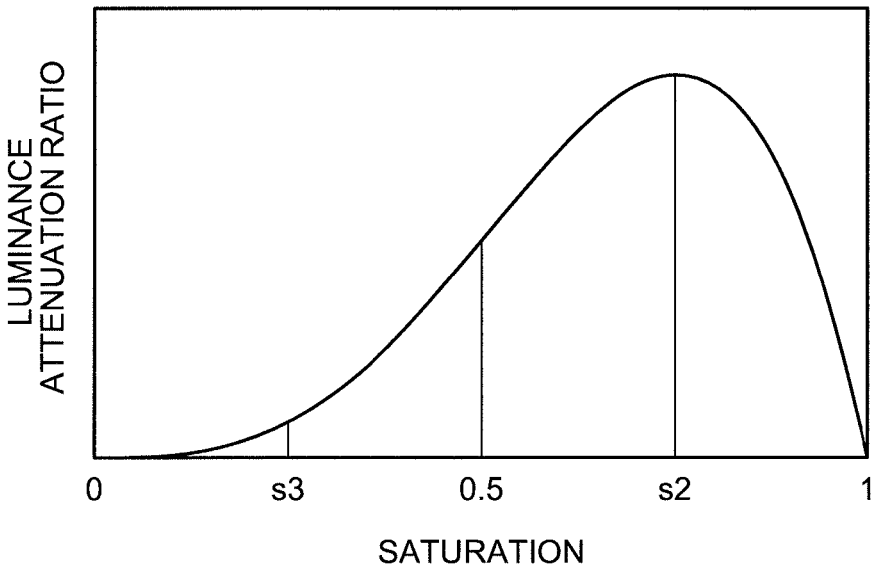
FIG. 10B is schematic diagram illustrating a relationship between saturation and luminance attenuation ratio according to modification 1.
Figure 11A:
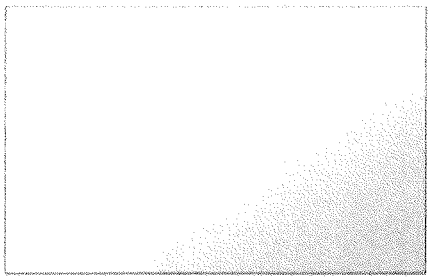
FIG. 11A is a color pattern image without any image processing having been applied.
Figure 11B:
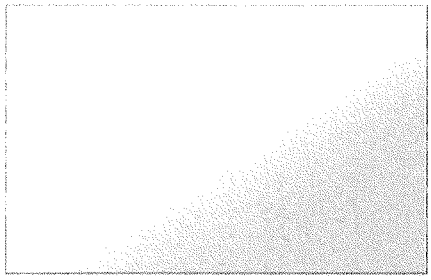
FIG. 11B is a color pattern image subsequent to image processing according to the first embodiment.
Figure 11C:
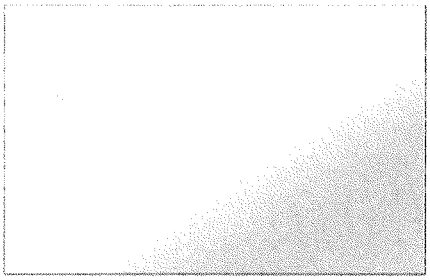
FIG. 11C is a color pattern image subsequent to image processing method according to the modification 1.

Now, a modification 1 of the first embodiment is described below. The modification 1 is different from the first embodiment in that luminance attenuation ratio is calculated according to saturation. FIG. 10A is schematic diagram illustrating a relationship between saturation and luminance according to modification 1. FIG. 10B is schematic diagram illustrating a relationship between saturation and luminance attenuation ratio according to modification 1. FIG. 11A is a color pattern image prior to image processing method according to the embodiment. FIG. 11B is a color pattern image subsequent to image processing according to the first embodiment. FIG. 11C is a color pattern image subsequent to image processing method according to the modification 1.

In FIG. 10A, a vertical axis stands for luminance and a horizontal axis stands for saturation. In FIG. 10A, a line 'c' indicates a relationship between saturation and luminance under hue B. Here, hue B is not limited to a particular color. That is, hue B may be an arbitrary color. FIG. 10B is schematic diagram illustrating a relationship between saturation and luminance attenuation ratio according to the modification 1. In FIG. 10B, a vertical axis stands for luminance attenuation ratio and a horizontal axis stands for saturation. In FIG. 10A, a curvature 'd' indicates a relationship between saturation and luminance under hue B in a case where luminance is decreased on the basis of the relationship illustrated in FIG. 10B according to the modification 1.

As illustrated in FIG. 10B, similar to the first embodiment, luminance attenuation ratio is equal to zero at points where saturation is zero and 1. Luminance attenuation ratio is maximum at a point where saturation is s2. In this modification 1, an increasing rate of luminance attenuation ratio within a range from saturation s3 to saturation s2 is greater than that of luminance attenuation ratio within a range from saturation 0 to saturation s3. Saturation of saturation s3 is smaller than that of saturation s2. In other words, the conversion unit 10 according to modification 1 decreases luminance attenuation ratio ratio within a low saturation range saturation no more than saturation s3, while the conversion unit 10 increases luminance attenuation ratio ratio within a middle saturation range from saturation s3 to saturation s2. As described above, a human being likely recognizes degradation of an image displayed on the image display portion 30 when saturation is small.

Therefore, the conversion unit 10 according to modification 1 suppresses degradation of the image by decreasing luminance attenuation ratio in the low saturation range saturation no more than saturation s3. For example, yellow has high luminance as hue. Luminance little decreases even if saturation is increased to come close to pure yellow. In such a case, it is remarkable for a human being to recognize degradation of the image in a range where saturation is low. That's why it is effective to decrease luminance attenuation ratio in the low saturation range saturation no more than saturation s3 in order to suppress degradation of image. On the other hands, a human being unlikely recognizes degradation of the image displayed on the image display portion 30 when saturation is large. Therefore, the conversion unit 10 according to the modification 1 increases luminance attenuation ratio in a middle saturation range from saturation s3 to saturation s2. The middle saturation range of saturation is likely used. The conversion unit 10 according to the modification 1 can significantly reduce power consumption by appropriately decreasing luminance in a range frequently used.

For example, when luminance of each of yellow and green is decreased according to modification 1, a change of image quality is described in detail below. As can be seen from FIGS. 8B and 10B, in a range of low saturation, decreasing of luminance attenuation ratio according to the modification 1 is greater than that of luminance attenuation ratio according to the first embodiment. FIG. 11A is a color pattern image prior to image processing method according to the embodiment. FIG. 11B is a color pattern image subsequent to image processing according to the first embodiment. FIG. 11C is a color pattern image subsequent to image processing method according to the modification 1. In FIGS. 11A, 11B, and 11C, yellow is illustrated at an upper-left area. Green is illustrated at an lower-right area. On a line which goes straight from a lower-left corner to an upper-right corner through a center of the figures, saturation is zero. As being close to the upper-left corner from the line, saturation is higher. As being close to the lower-right corner from the line, saturation is higher. When saturation is low, the color is close to a white. Therefore, in an area in the vicinity of the line, the color is bright and white. Furthermore, as being close to the upper-left corner and being close to the lower-right corner, the image is darker in color due to a higher saturation. As illustrated in FIGS. 11A and 11B, despite luminance is decreased according to the first embodiment, the change of impression for the image can be suppressed. On the other side, modification 1 decreases luminance attenuation ratio rather than the first embodiment 1 in a lower saturation area. Comparing to the first embodiment, as can be seen from FIG. 11C, the image is not dark because a luminance attenuation ratio is small near the center of the drawing where saturation is low (i.e., a white color area of modification 1 is larger than that of the first embodiment.). In other words, especially near the center of the drawing, the color pattern as illustrated in FIG. 11C gives a viewer an impression of color pattern that is substantially identical to that of the color pattern in FIG. 11A with no luminance attenuation ratio applied. In this way, degradation of the image is preferably suppressed. According to modification 1, in hue with a high luminance, for example yellow, green, and the like, the power consumption can be effectively reduced while suppressing degradation of the image.

Furthermore, as illustrated in FIG. 10B, in HSV space, saturation s2 falls preferably in a range of equal to and greater than 0.5, and of smaller than 1, more preferably 0.6 to 0.8. As described above, it is effective for the color of high luminance to decrease the luminance attenuation ratio in a low saturation area in order to suppress degradation of the image quality. It is possible to preferably accomplish decreasing luminance attenuation ratio in the low saturation area by means of setting in a high saturation area saturation s2 at which luminance attenuation ratio is maximum.

Figure 12A:
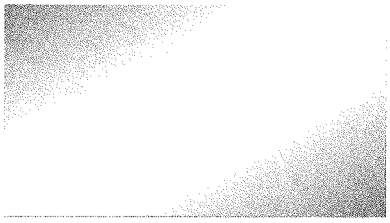
FIG. 12A is a color pattern image without any image processing having been applied.
Figure 12B:
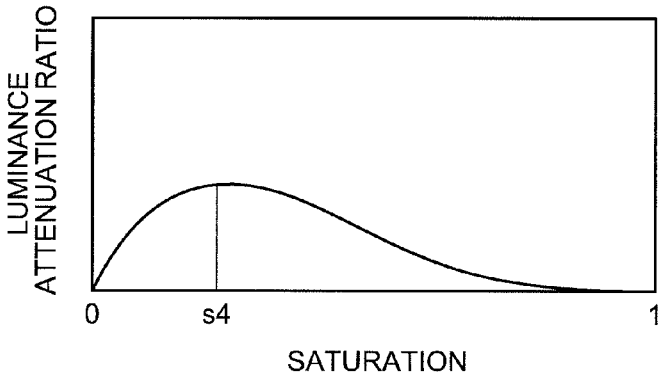
FIG. 12B is schematic diagram illustrating a relationship between saturation and luminance attenuation ratio according to modification 2.
Figure 12C:
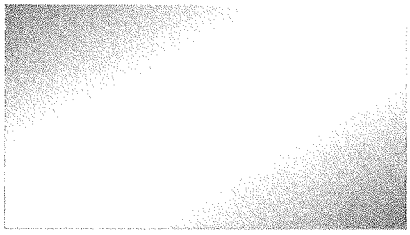
FIG. 12C is a color pattern image subsequent to image processing according to the modification 2.
Figure 12D:
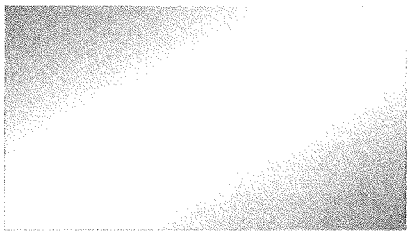
FIG. 12D is a color pattern image subsequent to image processing according to the modification 1.

For example, image quality of each of yellow and green whose luminance are decreased according to modification 1 is described below. In a case where saturation at which luminance attenuation ratio is maximum according to the first embodiment falls within equal to and less than 0.5, image qualities are compered on the basis of a relationship between saturation and luminance attenuation ratio (hereinafter, referring as to modification 2 when appropriate). FIG. 12A is a color pattern image prior to image processing according to the embodiment. FIG. 12B is schematic diagram illustrating a relationship between saturation and luminance attenuation ratio according to modification 2. FIG. 12C is a color pattern image subsequent to image processing according to the modification 2. FIG. 12D is a color pattern image subsequent to image processing according to the modification 1. As described above, in modification 2, saturation s4 at which luminance attenuation ratio is maximum is equal to and less than 0.5 in the HSV color space. On the other hand, in modification 1, saturation s2 at which luminance attenuation ratio is maximum is in a range of equal to and greater than 0.5, and of smaller than 1 exclusive in the HSV color space. Therefore, luminance attenuation ratio in a low saturation region of modification 1 is smaller than that of modification 2. FIG. 12A illustrates a color pattern with no luminance attenuation ratio having been applied. FIG. 12C illustrates a color pattern with the luminance attenuation ratio according to modification 2 having been applied. FIG. 12D illustrates a color pattern with the luminance attenuation ratio according to modification 1 having been applied. In FIGS. 12A, 12C, and 12D, yellow is illustrated at an upper-left area. Green is illustrated at an lower right area. On a line which goes straight from a lower-left corner to an upper-right corner through a center of the figures, saturation is zero. As being close to the upper-left corner from the line, saturation is higher. As being close to the lower-right corner from the line, saturation is higher. When saturation is low, the color is close to a white. Therefore, in an area in the vicinity of the line, the color is bright and white. Furthermore, as being close to the upper-left corner and being close to the lower-right corner, the image is darker in color due to higher saturation. As illustrated in FIGS. 12A and 12C, despite luminance is decreased according to the modification 2, the change of viewer's impression for the image can be suppressed. On the other hand, modification 1 decreases luminance attenuation ratio rather than the modification 2 in a low saturation region. Comparing to the modification 2, as can be seen from FIG. 12D, the image processed according to modification 1 is not dark because a luminance attenuation ratio is small in the vicinity of a center of the drawing where saturation is small (i.e., a white color area of modification 1 is larger than that of the modification 2). In other words, especially near the center of the drawings, the color pattern as illustrated in FIG. 12D gives a viewer an impression of color pattern that is substantially identical to that of the color pattern in FIG. 12A with no luminance attenuation ratio having been applied. In the modification 1, degradation of the image is more preferably suppressed. According to modification 1, in hue with a high luminance, for example yellow, green, and the like, the power consumption can be effectively reduced while suppressing degradation of the image.

[Second Embodiment]

Figure 13:
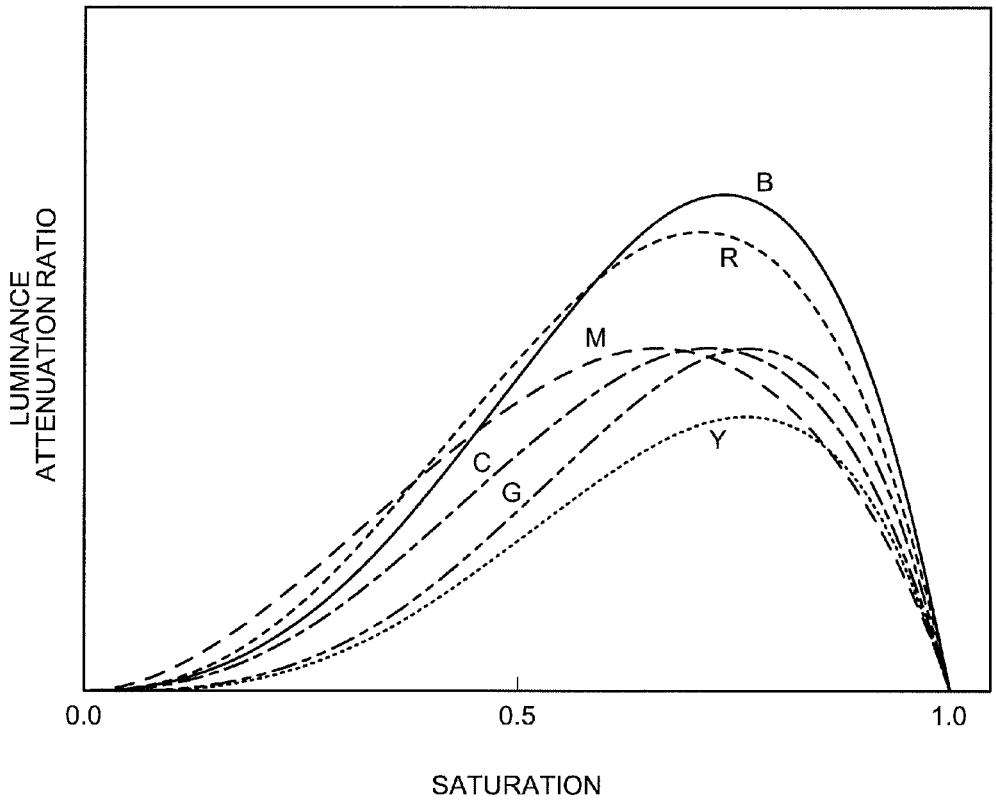
FIG. 13 is schematic diagram illustrating a relationship between saturation and luminance attenuation ratio with various hues.
Figure 14:
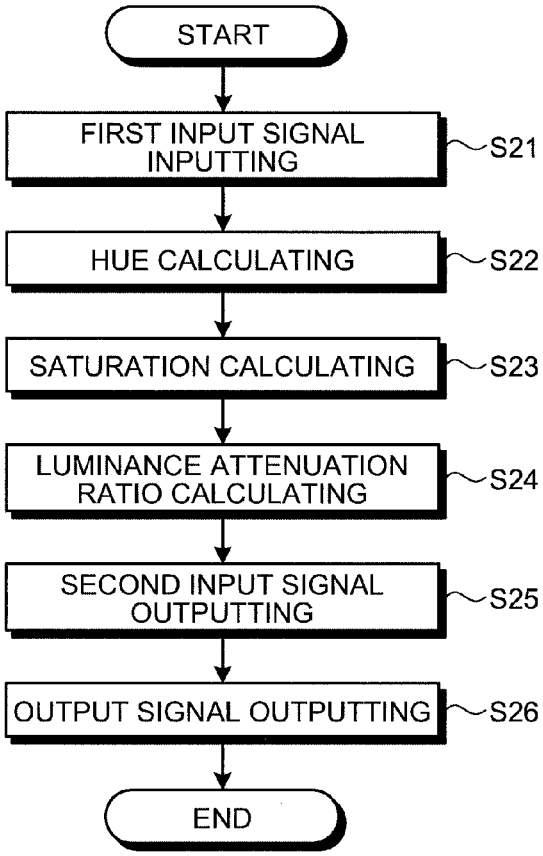
FIG. 14 is a flowchart illustrating an image processing method according to a second embodiment.

Now, second embodiment is described in detail below. FIG. 13 is schematic diagram illustrating a relationship between saturation and luminance attenuation ratio with various hues. FIG. 14 is a flowchart illustrating an image processing method according to a second embodiment. The second embodiment is different from the first embodiment in that a relationship between saturation and luminance attenuation ratio are stored associated with hue and luminance attenuation ratio is obtained on the basis of the identified hue and saturation. Elements substantially identical in function and configuration as those of the first embodiment are denoted by like reference numerals, and points where the modification differs from the first embodiment are mainly described below.

As described above, generally, the smaller saturation is, the higher luminance is because of coming close to a white. The greater saturation is, the lower luminance is. Furthermore, luminance varies in accordance with hue. For example, even if increasing saturation of yellow to be close to pure color, luminance little decreases because yellow has a high luminance as hue. That is, a relationship between saturation and luminance varies in accordance with a hue region. FIG. 13 illustrates a relationship between saturation and luminance attenuation ratio associated with hue. A curvatures R, G, B, Y, C, and M indicate relationship between saturation and luminance attenuation ratio associated with hue of red, green, blue, yellow, cyan, and magenta, respectively. In FIG. 13, luminance attenuation ratio of blue with low luminance is greater than that of yellow with high luminance. In the embodiment, the conversion unit 10 may store a relationship between saturation and luminance attenuation ratio associated with hue. The conversion unit 10 may calculate a luminance attenuation ratio on the basis of a relationship between saturation and luminance attenuation ratio, as well as saturation and hue. In this way, for example, it is more preferably accomplished to reduce power consumption by increasing the luminance attenuation ratio of blue with low luminance rather than another color. Furthermore, it is more preferably accomplished to suppress degradation of the image quality by decreasing luminance attenuation ratio of yellow with high luminance rather than another hue. The conversion unit 10 according to the second embodiment may store a look-up table indicating the relationship between saturation and luminance attenuation ratio associated with hue in FIG. 13 for example. The conversion unit 10 may calculate luminance attenuation ratio on the basis of the look-up table. It should be noted that the relationship in FIG. 13 is mere an example, the relationship is not limited thereto. For example, in accordance with color region of image display portion 30, the relationship between saturation and luminance attenuation ratio may vary in association with hue. Next, image processing method according to the second embodiment is described in detail below.

In image processing method according to the second embodiment, a hue calculating step is added to the method according to the first embodiment. As illustrated in FIG. 14, in a step S21, the conversion unit 10 according to the second embodiment receives the first input signal SRGB 1 including first color information from which a first color is reproduced at a predetermined pixel of the image display portion. The first color information is, if necessary, γ-converted, so that color values in RGB system are converted into input values in the HSV color space.

Subsequently, in step S22, the conversion unit 10 according to the second embodiment performs calculation to obtain hue of a first color in the HSV color space based on the first color information. Subsequently, in step S23, the conversion unit 10 according to the second embodiment performs calculation to obtain saturation of a first color in the HSV color space based on the first color information. Subsequently, in step S24, the conversion unit 10 according to the second embodiment performs calculation to obtain a luminance attenuation ratio on the basis of a relationship between saturation and luminance attenuation ratio associated with hue from the look-up table stored in itself (for example, as illustrated in FIG. 13) the calculated hue in step S22 and the calculated saturation in step S23. Then, conversion unit 10 proceeds further steps (to step 25). Because the processes of steps S25 and S26 are similar to those of steps S14 and S15, detailed description of these steps is omitted.

In this way, the image processing device and the image display device according to the second embodiment can reduce power consumption while suppressing degradation of image because luminance can be decreased on the basis of the relationship between saturation and luminance attenuation ratio associated with hue.

[Third Embodiment]

Figure 15:
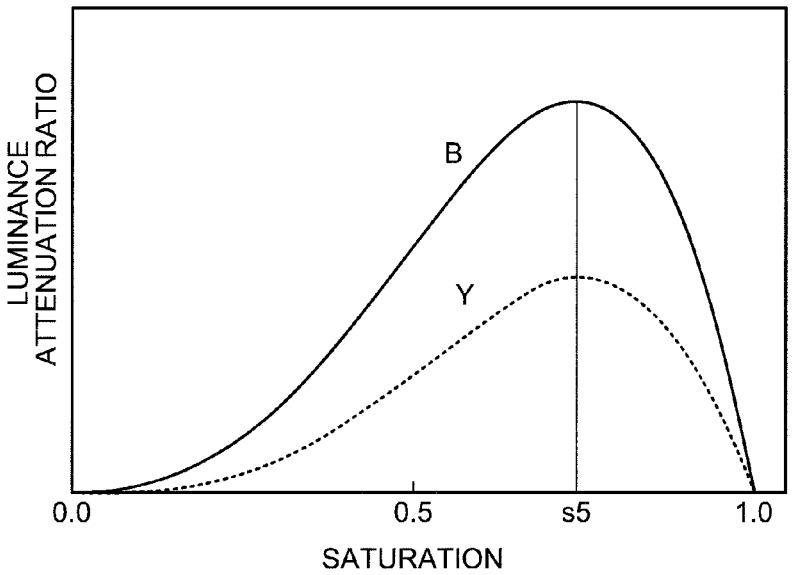
FIG. 15 is schematic diagram illustrating a relationship between saturation and luminance attenuation ratio according to a third embodiment.
Figure 16:
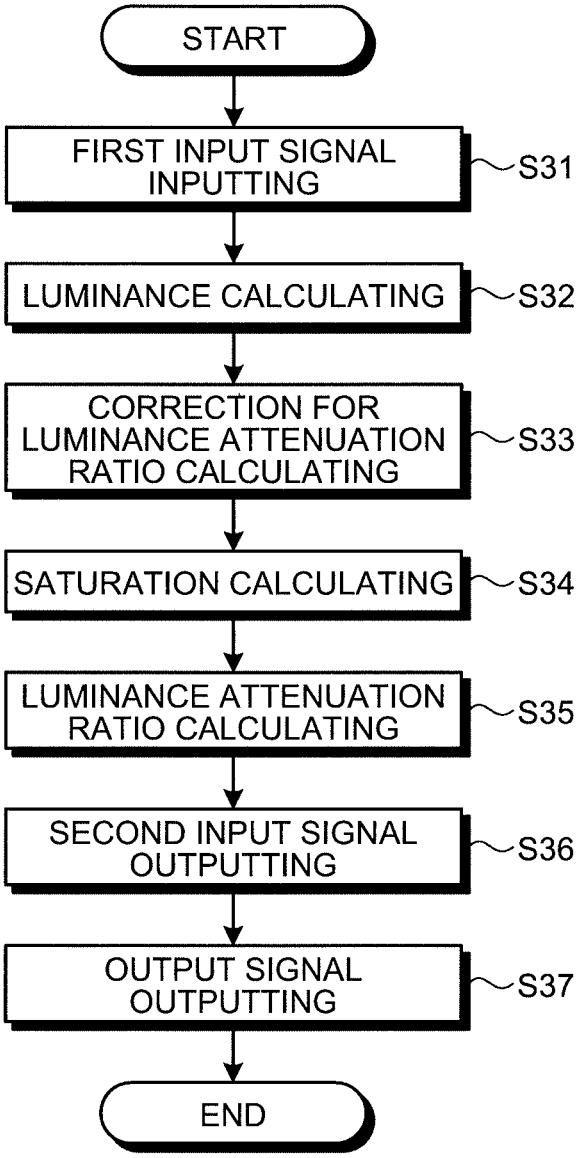
FIG. 16 is a flowchart illustrating an image processing method according to the third embodiment.

Now, a third embodiment is described in detail below. FIG. 15 is schematic diagram illustrating a relationship between saturation and luminance attenuation ratio according to a third embodiment. FIG. 16 is a flowchart illustrating an image processing method according to the third embodiment. The third embodiment is different from the first embodiment in that a luminance attenuation ratio is regulated after calculating luminance. Elements substantially identical in function and configuration as those of the first embodiment are denoted by like reference numerals, and points where the modification differs from the first embodiment are mainly described below.

Each of pixels has different luminance in accordance with gradation of the input signal as indicated formula (1). In other words, luminance differs in accordance with color and hue.

For example, each of cyan, green, and yellow has a high luminance, and blue has a low luminance. The impression of viewer for the image in which luminance is decreased, likely changes when luminance is higher. That's why, the conversion unit 10 according to the third embodiment performs a calculation to obtain luminance in order to regulate luminance attenuation ratio. For example, within a hue range such as cyan, green, yellow with high luminance, the conversion unit 10 decreases the luminance attenuation ratio.

In FIG. 15, a vertical axis stands for luminance attenuation ratio and a horizontal axis stands for saturation. A curvature B on FIG. 15 indicates a relationship between saturation and luminance attenuation ratio in a case where hue is blue. A curvature Y indicates a relationship between saturation and luminance attenuation ratio in a case where hue is yellow. The luminance attenuation ratio in accordance with saturation in which hue is yellow is obtained by multiplying luminance attenuation ratio in accordance with saturation in which hue is blue by correction value 0.5.

According to the third embodiment, a relationship between saturation and luminance attenuation ratio under some hue as a reference is defined. Then, luminance of the input signal is obtained. Subsequently luminance attenuation ratio is regulated in accordance with the obtained luminance. For example, the conversion unit 10 stores a relationship between saturation and luminance attenuation ratio in a case where hue is blue as a look-up table. The conversion unit 10 performs calculation to obtain a relationship between saturation and luminance attenuation ratio in which hue is yellow by multiplying a relationship between saturation and luminance attenuation ratio in which hue is blue by a correction value in accordance with luminance in yellow (for example, 0.5). Here, in FIG. 15, although yellow and blue are represented, it is not limited thereto. Similar to yellow and blue, the conversion unit 10 can perform calculation to obtain a relationship between saturation under another hue and luminance attenuation ratio. That is, the conversion unit 10 can perform calculation to obtain a relationship between saturation and luminance attenuation ratio by multiplying a reference relationship between saturation and luminance attenuation ratio under any hue by a correction value in accordance with luminance. In this way, the image processing device and the image display device according to the third embodiment can reduce power consumption while suppressing degradation of image because luminance attenuation ratio can be regulated on the basis of correction value in accordance with luminance. The correction value is not limited to 0.5 as illustrated in FIG. 13. Furthermore, a reference relationship is not limited to the relationship between saturation and luminance attenuation ratio in which hue is blue. An image processing method according to the third embodiment is described in detail below.

In image processing method according to the third embodiment, a luminance calculating step and a correction calculating step are added to the method according to the first embodiment. As illustrated in FIG. 16, in a step S31, the conversion unit 10 according to the third embodiment receives the first input signal SRGB 1 including first color information from which a first color is reproduced at a predetermined pixel of the image display portion. The first color information is, if necessary, γ-converted, so that color values in RGB system are converted into input values in the HSV color space. Subsequently, in step S32, the conversion unit 10 according to the third embodiment performs calculation to obtain luminance of a first color in the HSV color space based on the first color information. Subsequently, in step S33, the conversion unit 10 according to the third embodiment performs calculation to obtain a correction value of luminance attenuation ratio based on the calculated luminance of the first color. Subsequently, in step S34, the conversion unit 10 according to the third embodiment performs calculation to obtain saturation of the first color in the HSV color space based on the first color information. Subsequently, in step S35, the conversion unit 10 according to the third embodiment performs calculation to obtain a luminance attenuation ratio on the basis of a relationship between saturation and luminance attenuation ratio from the look-up table stored in itself (for example, the curvature B as illustrated in FIG. 15) the calculated luminance correction value in step S33 and the calculated saturation in step S34. Then, conversion unit 10 proceeds further steps (to step 36). Because the processes of steps S36 and S37 are similar to those of steps S14 and S15 according to the first embodiment, detailed description of these steps is omitted.

In this way, the image processing device and the image display device according to the third embodiment can reduce power consumption while suppressing degradation of image because luminance attenuation ratio can be corrected in accordance with luminance.

[Fourth Embodiment]

Figure 17:
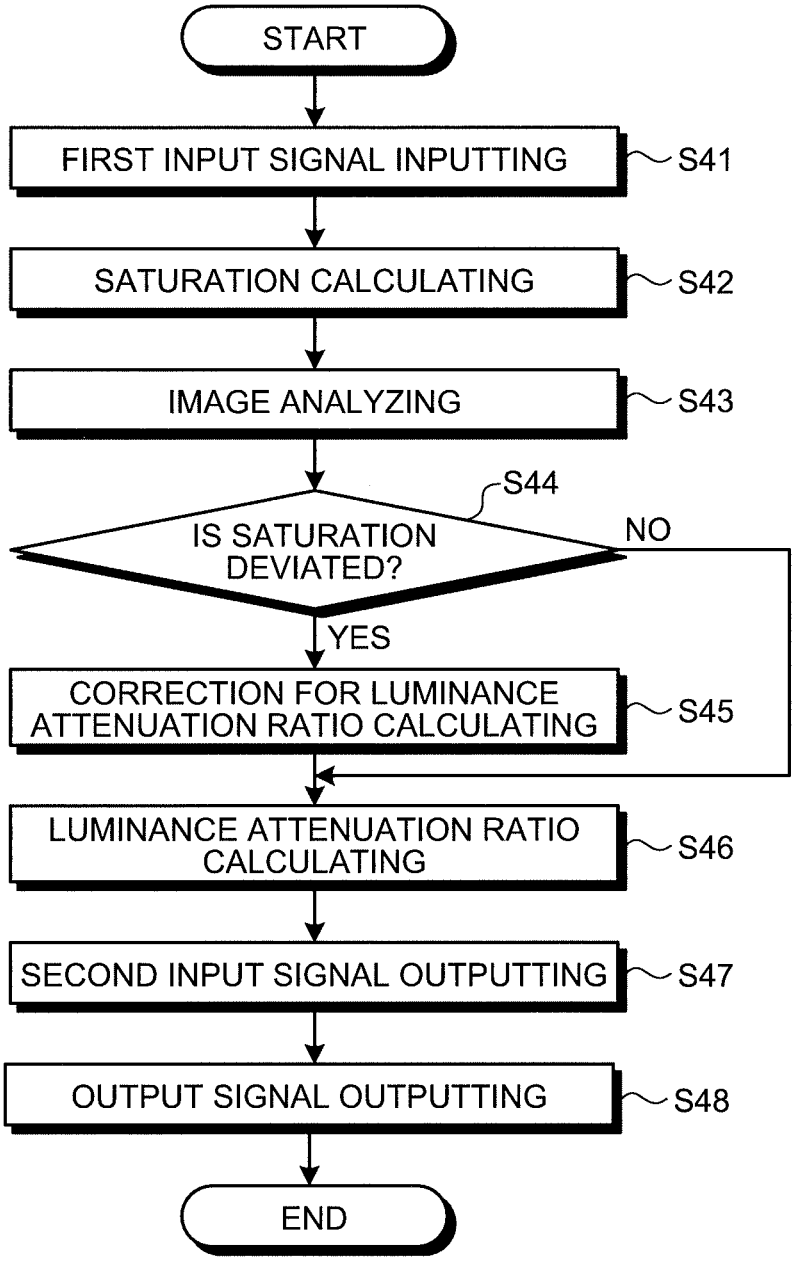
FIG. 17 is a flowchart illustrating an image processing method according to the fourth embodiment.

Now, a fourth embodiment is described in detail below. FIG. 17 is a flowchart illustrating an image processing method according to the fourth embodiment. The fourth embodiment is different from the first embodiment in that luminance attenuation ratio is regulated after analyzing deviation over entire pixels during one image frame. Elements substantially identical in function and configuration as those of the first embodiment are denoted by like reference numerals, and points where the modification differs from the first embodiment are mainly described below.

Figure 18:
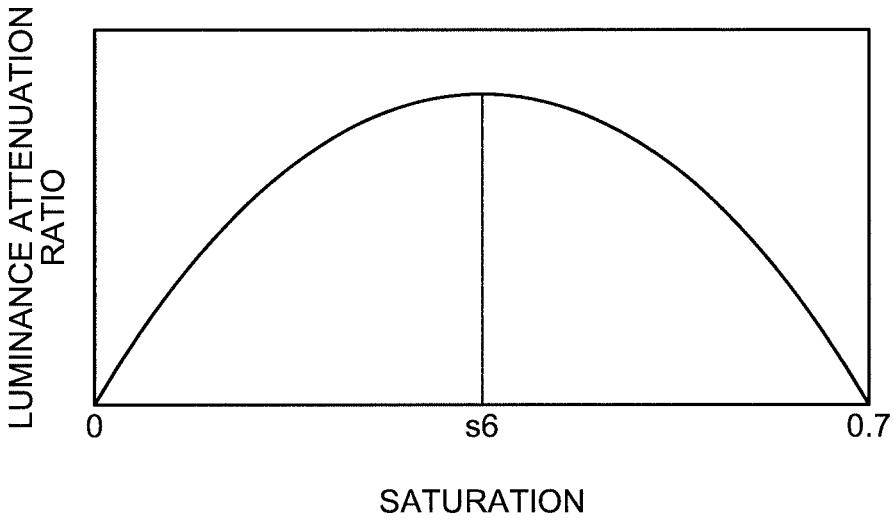
FIG. 18 is an exemplary schematic diagram illustrating a relationship between saturation and luminance attenuation ratio in a case where deviation of saturation is present according to the fourth embodiment.

FIG. 18 is an exemplary schematic diagram illustrating a relationship between saturation and luminance attenuation ratio in a case where deviation of saturation is present according to the fourth embodiment. When deviation of saturation is present at each of pixels in an image frame, a human being may be conscious about a change of impression for an image in which luminance is changed, thereby it leads to image degradation. For example, when the image frame includes a lot of pixels having saturation in which luminance attenuation ratio comes to be greater (for example, pixel having saturation close to saturation s1 where luminance attenuation ratio is maximum according to the first embodiment 1), and/or when the image frame consists of pixels having saturation in which luminance attenuation ratio comes to be greater, luminance attenuation ratio of entire image comes to be greater. In such a case, a human being may have a different impression for an image from an impression for an original image because the entire image becomes darker. Therefore, it is preferable to regulate luminance attenuation ratio in order to suppress the degradation of image quality. For example, the conversion unit 10 may optimize luminance attenuation ratio by normalizing luminance attenuation ratio with saturation included in an image. For instance, in such a case where deviation of saturation of each of pixels in the HSV color space falls within 0 to 0.7, the conversion unit 10 may replace a dimension of the horizontal axis of FIG. 8B (i.e., a magnitude of saturation 0 to 1) with that of FIG. 18 (i.e., a magnitude of saturation 0 to 0.7). That is, as illustrated in FIG. 18, only a dimension of the horizontal axis is altered to be an axis with a magnitude of saturation 0 to 0.7 with the curvature being kept unchanged. In such a case, luminance attenuation ratio comes to be a maximum at saturation s6, and luminance attenuation ratio comes to be zero at saturation zero and 0.7.

Figure 19:
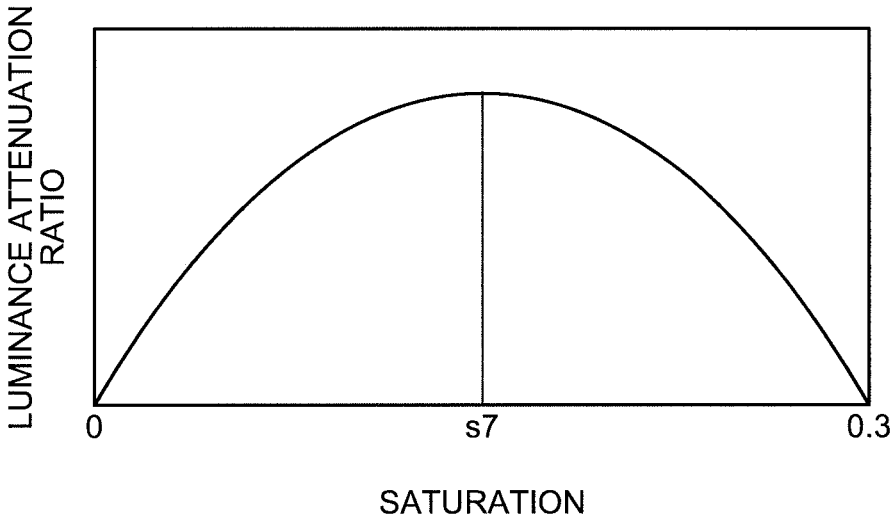
FIG. 19 is an exemplary schematic diagram illustrating a relationship between saturation and luminance attenuation ratio in a case where deviation of saturation is present according to the fourth embodiment.

FIG. 19 is an exemplary schematic diagram illustrating a relationship between saturation and luminance attenuation ratio in a case where deviation of saturation is present according to the fourth embodiment. As examples of an image having saturation deviation includes such an image in which an image frame thereof includes a lot of pixels having low saturation in which luminance attenuation ratio comes to be small (for example, pixel having saturation close to saturation 0 in which luminance attenuation ratio is zero according to the first embodiment 1), and/or such an image that consists of pixels having low saturation in which luminance attenuation ratio comes to be small, thereby luminance attenuation ratio of entire image comes to be small. In such a case, even if luminance attenuation ratio comes to be much greater, a human being may unlikely have a different impression for the image from an impression for an original image because the entire image is luminous due to low saturation. Therefore, it is preferable to regulate luminance attenuation ratio to be greater in order to suppress power consumption preferably. For example, the conversion unit 10 may optimize luminance attenuation ratio by employing normalization for saturation included in the image.

For instance, in such a case where deviation of saturation of each of pixels in the HSV color space falls within zero to 0.3, the conversion unit 10 may replace a dimension of the horizontal axis of FIG. 8B (i.e., a magnitude of saturation 0 to 1) with that of FIG. 19 (i.e., a magnitude of saturation zero to 0.3). That is, as illustrated in FIG. 19, only a dimension of the horizontal axis is altered to be an axis with a magnitude of saturation 0 to 0.3 with the curvature being kept unchanged. In such a case, luminance attenuation ratio comes to be a maximum at saturation s7, and luminance attenuation ratio comes to be zero at saturation zero and 0.3.

Figure 20:
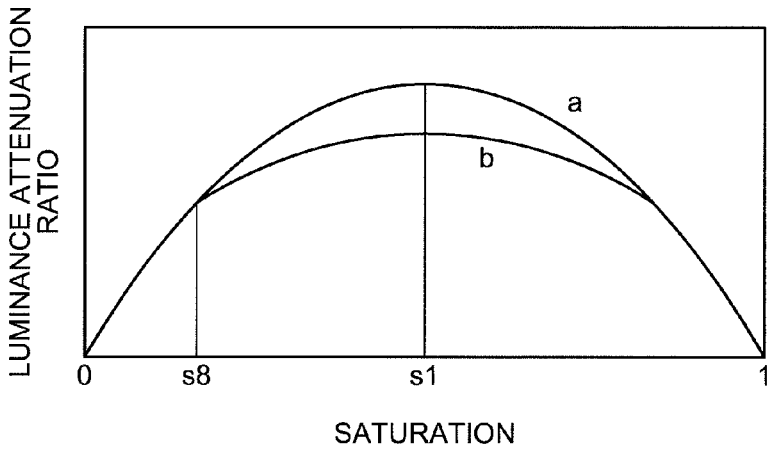
FIG. 20 is an exemplary schematic diagram illustrating a relationship between saturation and luminance attenuation ratio in a case where deviation of saturation is present according to the fourth embodiment.

FIG. 20 is an exemplary schematic diagram illustrating a relationship between saturation and luminance attenuation ratio in a case where deviation of saturation is present according to the fourth embodiment. As an example of such an image having saturation deviation includes an image in which contrast is high between a part of pixels having saturation in which luminance attenuation ratio comes to be great and a part of pixels having low saturation in which luminance attenuation ratio comes to be small (for example, contrast is high between blue whose saturation is middle and white whose saturation is low), thereby luminance of apart of pixels having saturation in which luminance attenuation ratio comes to be great significantly decreases, and luminance of a part of pixels having low saturation in which luminance attenuation ratio comes to be small little decreases. In such a case, a human being may likely recognize a dark part where luminance significantly decreases, he/she has a different impression for an image from an impression for an original image. Therefore, it is preferable to regulate luminance attenuation ratio at pixel having saturation in which luminance attenuation ratio comes to be greater to be small in order to suppress degradation of image quality. In FIG. 20, a curvature 'a' indicates a relationship between saturation and luminance attenuation ratio according to the first embodiment. A curvature 'b' indicates a relationship between saturation and luminance attenuation ratio with deviation present according to the fourth embodiment. For example, when contrast is high between a part including pixels having saturation s1 in which luminance attenuation ratio comes to be maximum according to the first embodiment and a part including pixels having saturation s8 where luminance attenuation ratio comes to be small according to the first embodiment, a human being may have a different impression for an image from an impression for an original image because luminance significantly decreases at saturation s1 In the fourth embodiment, as the curvature 'b' illustrated in FIG. 20, luminance attenuation ratio at saturation s1 is lowered relative to the curvature 'a' according to the first embodiment in order to bring luminance attenuation ratio at saturation s1 to be closer to luminance attenuation ratio at saturation s8. Next, image processing method according to the fourth embodiment is described below.

In image processing method according to the fourth embodiment, an deviation calculating step and a luminance attenuation ratio correction calculating step are added to the method with respect to the first embodiment. As illustrated in FIG. 17, in a step S41, the conversion unit 10 according to the fourth embodiment receives the first input signal SRGB 1 including first color information from which a first color is reproduced at predetermined pixels of the image display portion. The first color information is, if necessary, γ-converted, so that color values in RGB system are converted into input values in the HSV color space. Subsequently, in step S42, the conversion unit 10 according to the fourth embodiment performs calculation to obtain saturation of a first color in the HSV color space based on the first color information.

Subsequently, in step S43, the conversion unit 10 according to the fourth embodiment performs an image analysis of the input image signal. Alternatively, in step S43, the conversion unit 10 according to the fourth embodiment may receive image analysis information of the input image signal from an external device and/or another processing. Subsequently, in step S44, the conversion unit 10 according to the fourth embodiment determines whether or not deviation of saturation over entire image is present as well as whether or not the deviation is beyond a predetermined threshold. As a result of the determination, when deviation of saturation over entire image is present as well as the deviation is beyond a predetermined threshold ('Yes' in step S44), the conversion unit 10 according to the fourth embodiment proceeds the process to step S45. Otherwise ('No' in step S44), the conversion unit 10 proceeds the process to step S46. Because the processes of steps S46 to S48 are similar to those of steps S13 to S15 according to the first embodiment, detailed description of these steps is omitted.

As described above, when deviation of saturation over entire image is present as well as the deviation is beyond a predetermined threshold ('Yes' in step S44), the conversion unit 10 according to the fourth embodiment proceeds the process to step S45.

In step S45, the conversion unit 10 performs calculation to obtain a correction value of luminance attenuation ratio in accordance with saturation on the basis of saturation deviation over entire image and stores it in itself. For example, when there is the deviation in pixels having saturation in which luminance comes to be greater, the conversion unit 10 performs calculation to correct luminance attenuation ratio by normalizing the luminance attenuation ratio with saturation included in the image. Furthermore, for instance, in such a case where the image consists of pixels having low saturation, the conversion unit 10 performs calculation to correct luminance attenuation ratio so as to increase luminance attenuation ratio. Furthermore, for example, in such a case where the image contrast is high between a part including pixels having saturation in which luminance comes to be greater and a part including pixels having low saturation, the conversion unit 10 performs calculation to correct luminance attenuation ratio so as to decrease luminance attenuation ratio of pixels having saturation in which luminance comes to be greater.

Subsequently, in step S46, the conversion unit 10 performs calculation to obtain luminance attenuation ratio on the basis of a relationship between saturation and luminance attenuation ratio from the stored look-up table as illustrated in FIG. 8B for example, the saturation calculated in step S42, and the luminance attenuation ratio correction calculated in step S45.

In this way, the image processing device and the image display device according to the fourth embodiment can more preferably reduce power consumption while suppressing degradation of image because luminance attenuation ratio can be corrected even if deviation of saturation is present.

[Fifth Embodiment]

Figure 21:
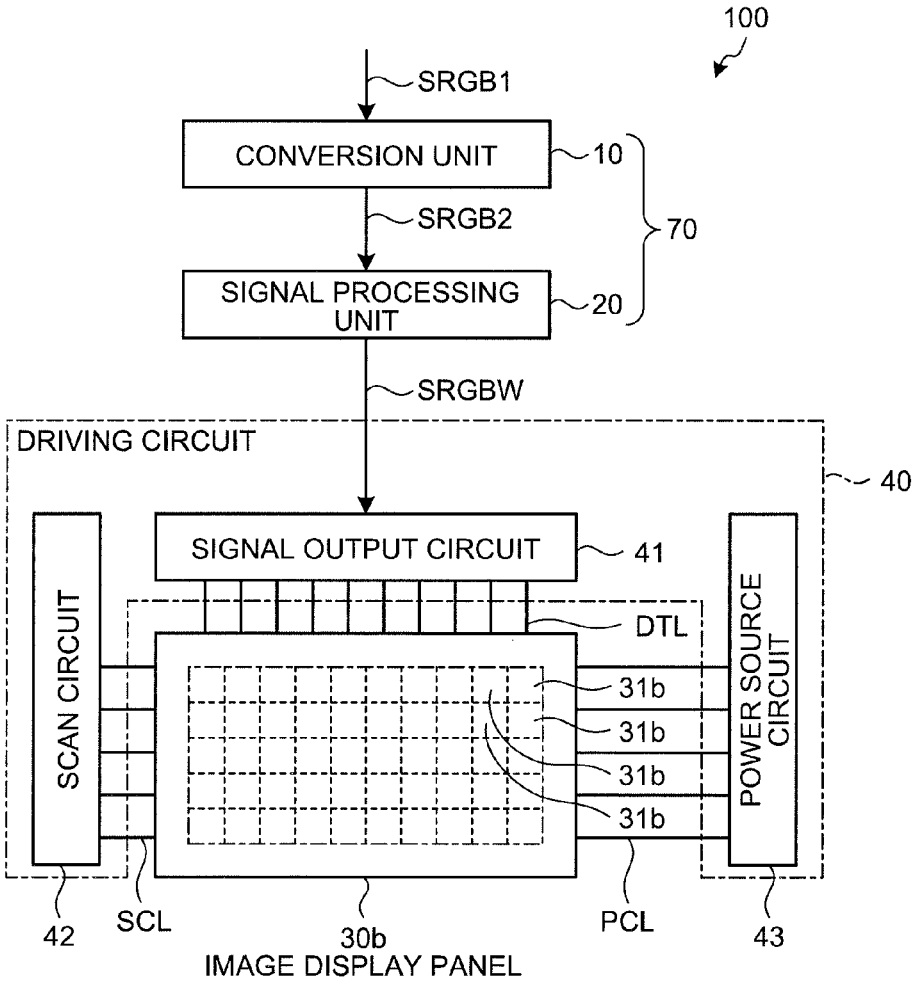
FIG. 21 is a schematic block diagram illustrating a configuration of the image processing device and the display device according to a fifth embodiment.
Figure 22:
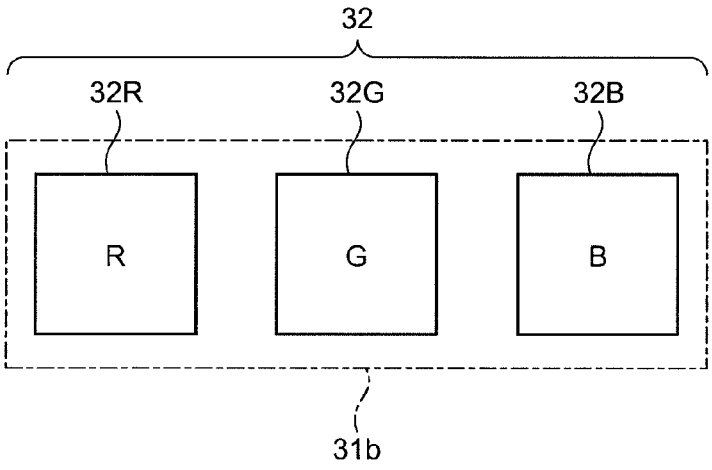
FIG. 22 is an exemplary diagram of arrangement of sub-pixels of the image display portion according to the fifth embodiment.
Figure 23:
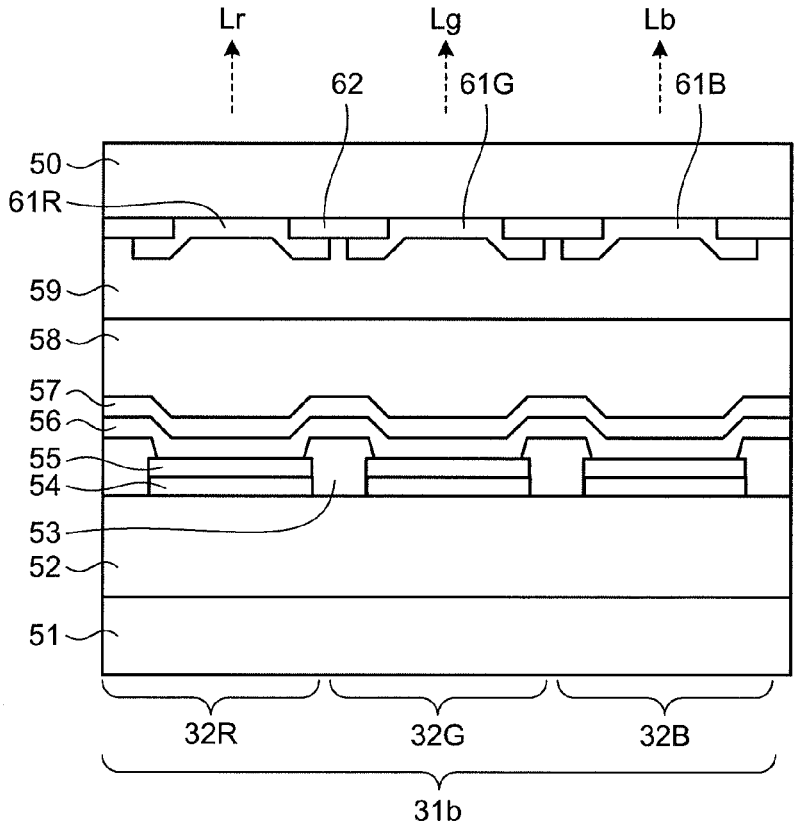
FIG. 23 is a cross-sectional view of the image display portion according to the fifth embodiment.
Figure 24:
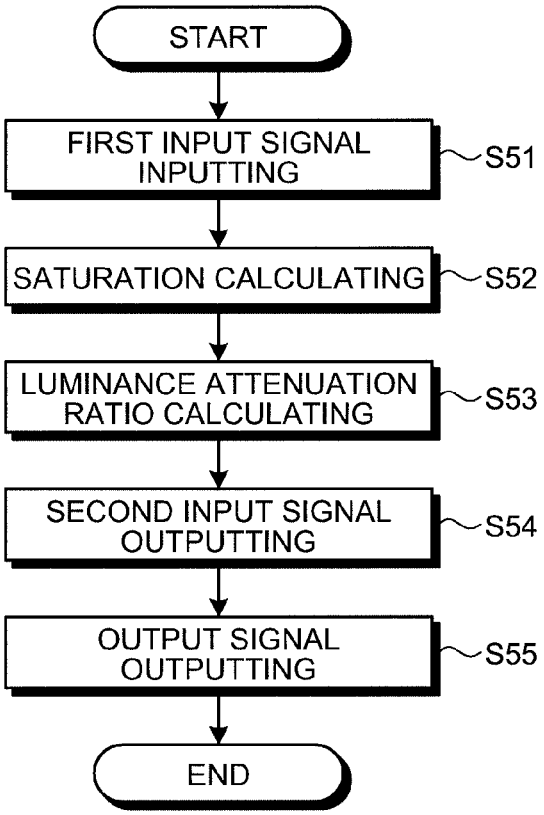
FIG. 24 is a flowchart illustrating an image processing method according to the fifth embodiment.

Now, a fifth embodiment is described in detail below. FIG. 21 is a schematic block diagram illustrating a configuration of the image processing device and the display device according to a fifth embodiment. FIG. 22 is an exemplary diagram of arrangement of sub-pixels of the image display portion according to the fifth embodiment. FIG. 23 is a cross-sectional view of the image display portion according to the fifth embodiment. FIG. 24 is a flowchart illustrating an image processing method according to the fifth embodiment. The fifth embodiment is different from the first embodiment in that an output signal is generated by three primary colors instead of the four colors. Elements substantially identical in function and configuration as those of the first embodiment are denoted by like reference numerals, and points where the modification differs from the first embodiment are mainly described below.

As illustrated in FIG. 21, the signal processing unit 20 is connected to the image display panel driving circuit 40 for controlling a drive of the image display panel 30*b*. Signal processing unit 20 according to the fifth embodiment passes the color converting step, so that the input signal having input values (the second input signal SRGB2) in the HSV color space is output as a first color, a second color, and a third color.

As illustrated in FIG. 22, the pixel 31*b* includes, for example, a first sub-pixel 32R, a second sub-pixel 32G, and a third sub-pixel 32B. The first sub-pixel 32R displays a first primary color (for example, a red color (R) component). The second sub-pixel 32G displays a second primary color (for example, a green color (G) component). The third sub-pixel 32B displays a third primary color (for example, a blue color (B) component).

The image display panel 30*b* may be a color display panel. As illustrated in FIG. 23, a first color filter 61R is located between the first sub-pixel 32R and a user who views an image such that only the first primary color component Lr among primary color components of the self-emitting layer 56 can pass therethrough. A second color filter 61G is located between the second sub-pixel 32G and the user such that only the second primary color component Lg among the primary color components of the self-emitting layer 56 can pass therethrough. A third color filter 61B is located between the third sub-pixel 32B and the user such that only the third primary color component Lb among the primary color components of the self-emitting layer 56 can pass therethrough.

The image processing device and image display device according to the fifth embodiment associates the output signal with three primary colors which is the same as the input signal. The image processing device and image display device according to the fifth embodiment decrease luminance of pixels on the basis of the relationship between saturation and luminance attenuation ratio. Therefore, it is possible to reduce power consumption while appropriately decreasing luminance within a rage where image quality does not degrade. Next, referring to FIG. 24, an image processing method according to the fifth embodiment is described in detail below.

As illustrated in FIG. 21, in a step S51, the conversion unit 10 receives the first input signal SRGB 1 including first color information from which a first color is reproduced at a predetermined pixel of the image display portion. Because the processes of steps S52 to S54 are similar to those of steps S12 to S14 according to the first embodiment, detailed description of these steps is omitted.

Subsequently, in step S55, the signal processing unit 20 according to the fifth embodiment outputs the second input signal without any conversion having been applied as an output signal to the driving circuit 40 to drive the image display portion 30.

In this way, the image processing device and the image display device according to the fifth embodiment can appropriately reduce power consumption within a range where the image does not degrade because luminance can be decreased on the basis of the relationship between saturation and luminance attenuation ratio.

[Application]

Examples applying the display device 100 according to the first embodiment, the second embodiment, the third embodiment, the fourth embodiment, the fifth embodiment and the modifications thereof are described below with reference to FIGS. 25-33. In the following, the first embodiment, the second embodiment, the third embodiment, the fourth embodiment, the fifth embodiment and the modifications thereof are described as the present embodiment. The display device 100 according to the present embodiment can be applicable to an electronic apparatus in any fields of a mobile terminal device such a mobile phone, smart phone, a television device, a digital camera, a laptop computer, a video camera and a meter provided in a vehicle. In other words, the display device 100 according to the present embodiment can be applicable to an electronic apparatus which displays image signal generated internally or input from external device as still image or moving image. The electronic apparatus includes a control device that supplies image signals to the display device 100 and control operation thereof.

[Application Example 1]

Figure 25:
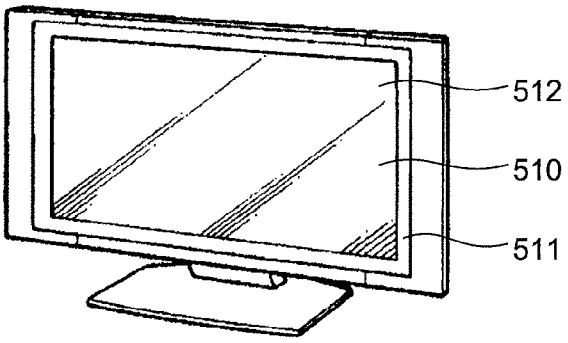
FIG. 25 is schematic diagram illustrating an exemplary electronic apparatus to which the display device according to the embodiment is applied.

FIG. 25 is schematic diagram illustrating a television apparatus to which the display device 100 according to the present embodiment is applied. The television apparatus includes an image display unit 510 with a front panel 511 and a filter glass 512. The image display unit 510 corresponds to the display device 100 according to the present embodiment.

[Application Example 2]

Figure 26:
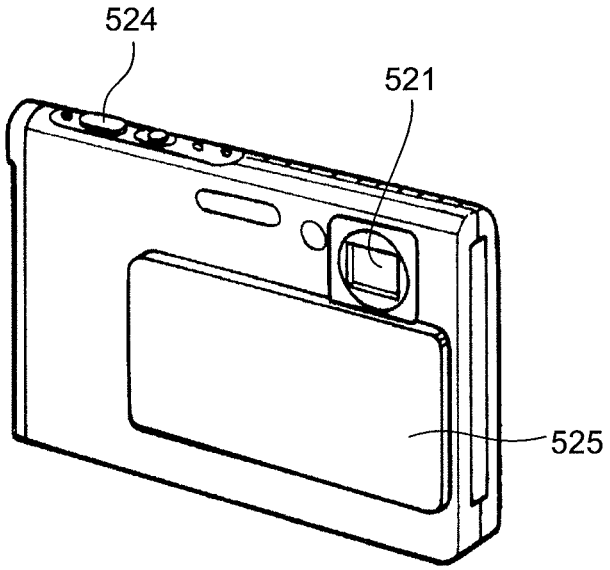
FIG. 26 is schematic diagram illustrating an exemplary electronic apparatus to which the display device according to the embodiment is applied.
Figure 27:
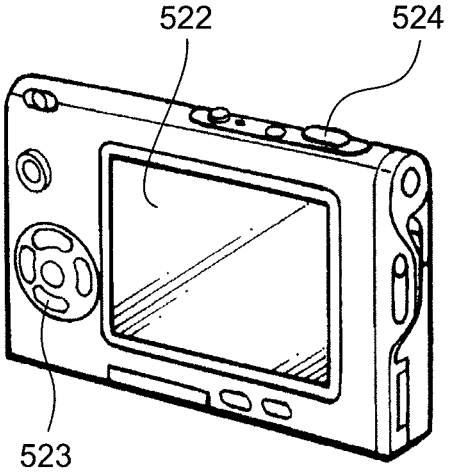
FIG. 27 is schematic diagram illustrating another exemplary electronic apparatus to which the display device according to the embodiment is applied.

FIGS. 26 and 27 are schematic diagrams illustrating a digital camera to which the display device 100 according to the present embodiment is applied. The digital camera includes light emitting unit 521 for flash, rear monitor 522, function button 523, and a shutter button 524. The rear monitor 522 corresponds to the display device 100 according to the present embodiment. As illustrated in FIG. 26, the digital camera includes lens cover 525. Upon sliding the lens cover 525, lens appears. The digital camera can capture digital pictures by receiving incident light through the lens.

[Application Example 3]

Figure 28:
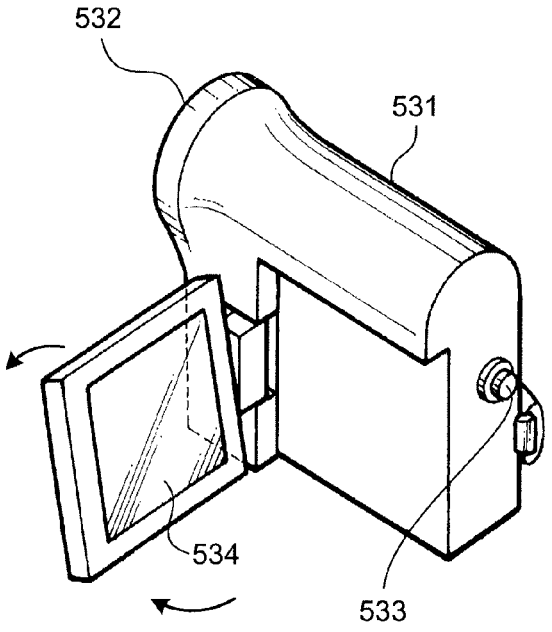
FIG. 28 is schematic diagram illustrating further exemplary electronic apparatus to which the display device according to the embodiment is applied.

FIG. 28 is schematic diagram illustrating a video camera to which the display device 100 according to the present embodiment is applied. The video camera includes a body 531, lens for capturing 532 mounted on front side, a start/stop button 533, and a monitor 534. The monitor 534 corresponds to the display device 100 according to the present embodiment.

[Application Example 4]

Figure 29:
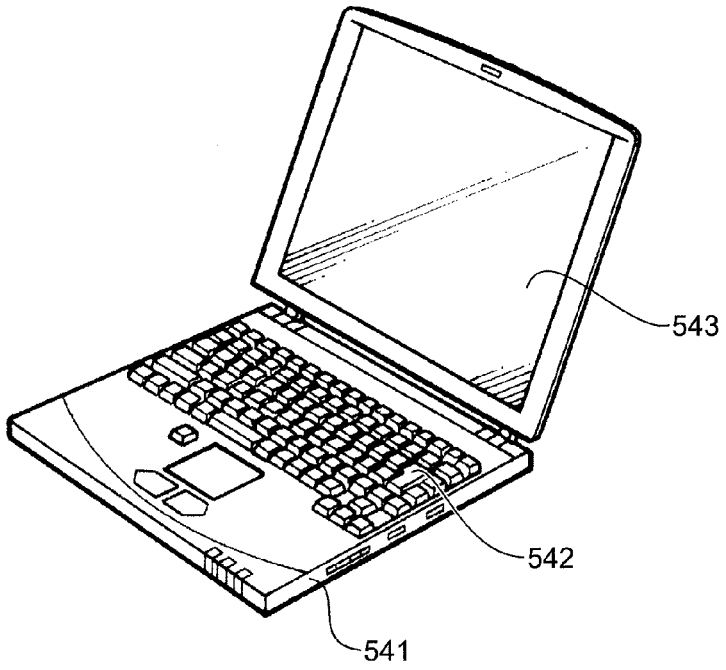
FIG. 29 is schematic diagram illustrating further exemplary electronic apparatus to which the display device according to the embodiment is applied.

FIG. 29 is schematic diagram illustrating a laptop computer to which the display device 100 according to the present embodiment is applied. The laptop computer includes a body 541, keys 542 for text input and a display 543 for displaying an image. The display 543 corresponds to the display device 100 according to the present embodiment.

[Application Example 5]

Figure 30:
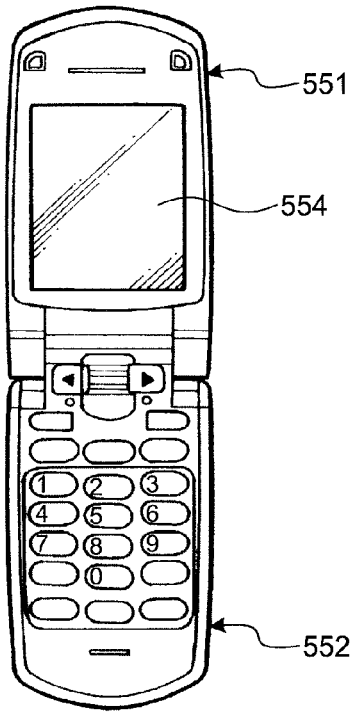
FIG. 30 is schematic diagram illustrating further exemplary electronic apparatus to which the display device according to the embodiment is applied.
Figure 31:
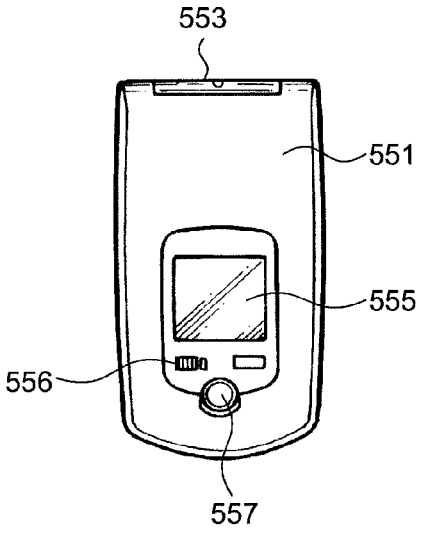
FIG. 31 is schematic diagram illustrating further exemplary electronic apparatus to which the display device according to the embodiment is applied.

FIGS. 30 and 31 are schematic diagrams illustrating a mobile phone to which the display device 100 according to the present embodiment is applied. FIG. 30 illustrates the mobile phone with opened. FIG. 31 illustrates the mobile phone with folded. The mobile phone includes a top case 551, bottom case 552 that is connect to the top case 551 with a hinge 553, a display 554, a sub-display 555, a picture light 556 and a camera 557. The display 554 corresponds to the display device 100 according to the present embodiment. The display 554 may further include touch detection function.

[Application Example 6]

Figure 32:
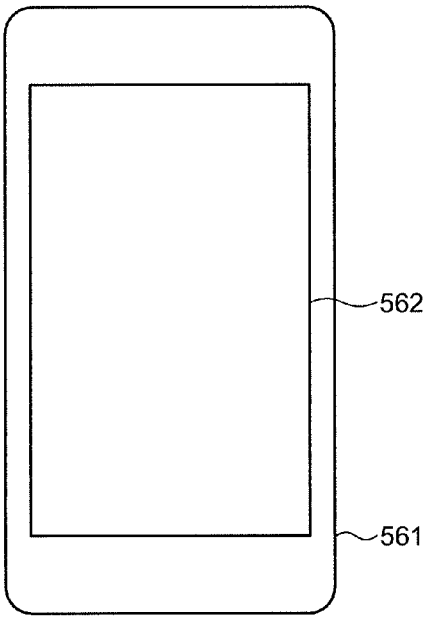
FIG. 32 is schematic diagram illustrating further exemplary electronic apparatus to which the display device according to the embodiment is applied.

FIG. 32 is schematic diagram illustrating a mobile information terminal to which the display device 100 according to the present embodiment is applied. The mobile information terminal may be for example a smart phone or a tablet terminal which function as a mobile computer, a multifunctional mobile phone, a mobile computer capable of communication and so on. The mobile information terminal includes display 562 on upper side of a case 561. The display 562 corresponds to the display device 100 according to the present embodiment.

[Application Example 7]

Figure 33:
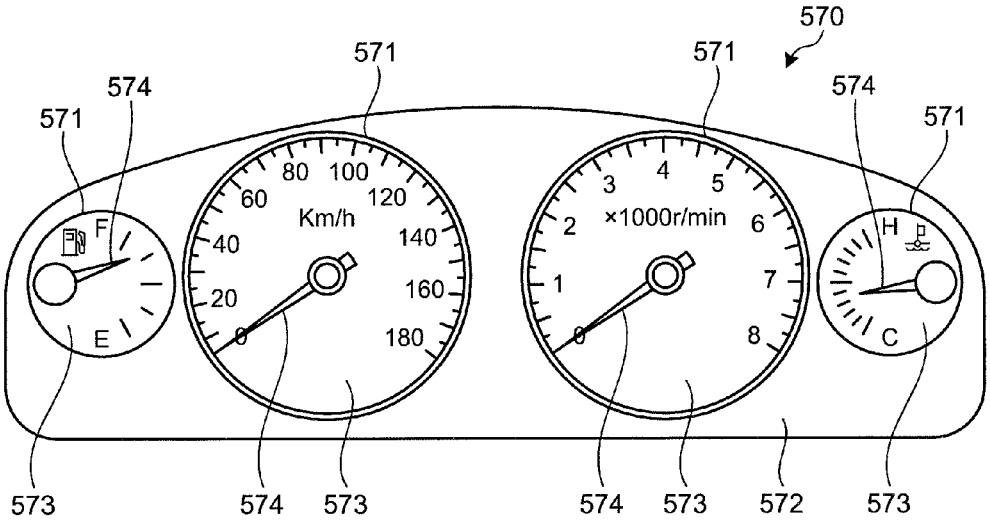
FIG. 33 is schematic diagram illustrating further exemplary electronic apparatus to which the display device according to the embodiment is applied.

FIG. 33 is schematic diagram illustrating a meter unit mounted on a vehicle to which the display device 100 according to the present embodiment is applied. The meter unit 570 includes meters 571 such as a fuel meter, a water temperature meter, a speed meter, and a tachometer, each of which correspond to the display device 100 according to the present embodiment. The meters 571 are covered with an instrument panel 572. The maters 571 may have a meter panel 573 and movement component.

The movement component includes a driving motor (not shown) and a pointer 574 dived thereby. The meter panel 573 can display a scale and warning for example. The pointer 574 can rotate on the meter panel 573.

In FIG. 33, a plurality of meters 571 are provided on one piece of instrument panel 572, but it is not limited thereto. For example, one of meter 571 corresponding to the display device 100 according to the present embodiment may be provided on the instrument panel 572. In this case, one of meter 571 displays a fuel meter, a water temperature meter, a speed meter, and a tachometer.

While certain embodiments have been described, these embodiments have been presented by way of example only, and are not intended to limit the scope of the inventions. Described components include components which skilled person in the art can conceive of, substantially the same, and in the range of equal. Described components can be combined each other. Indeed, the novel embodiments described herein may be embodied in a variety of other forms; furthermore, various omissions, substitutions and changes in the form of the embodiments described herein may be made without departing from the spirit of the inventions.

<Aspect of Present Disclosure>

The present disclosure includes aspects as follows.

(1) An image processing device including:

a conversion unit to receive a first input signal including first color information, a first color being reproduced at pixels on the basis of the first color information, the first input signal including first color information obtained from an input image signal corresponding to a red component, a green component and a blue component, to specify saturation of the first color, and configured to obtain luminance attenuation ratio on the basis of a relationship previously stored between saturation and luminance attenuation ratio, and the saturation of the first color, and to output a second input signal including second color information whose luminance is decreased from the first color information on the basis of the luminance attenuation ratio corresponding to the first color information; and a signal processing unit configured to output an output signal for driving the pixels on the basis of the second input signal.

(2) The image processing device according to (1), wherein the relationship in an HSV color space is such that: the luminance attenuation ratio comes to be zero at the saturation being zero and 1; the luminance attenuation ratio comes to be maximum at a first saturation; the luminance attenuation ratio increases as the saturation increases from zero to the first saturation; and the luminance attenuation ratio decreases as the saturation increases from the first saturation to 1.

(3) The image processing device according to (2), wherein: a second saturation is smaller than the first saturation, and an increasing rate of the luminance attenuation ratio as saturation increases from zero to the second saturation is smaller than an increasing rate of the luminance attenuation ratio as saturation increases from the second saturation to the first saturation.

(4) The image processing device according to (2), wherein the first saturation in the HSV color space falls in a range of saturation equal to and greater than 0.5, and smaller than saturation 1.

(5) The image processing device according to (1), wherein: the conversion unit stores the relationship associated with hue region, the conversion unit further specifies hue of the first color from the first color information, and the conversion unit obtains luminance attenuation ratio corresponding to the first color information on the basis of both the saturation and the hue.

(6) The image processing device according to (1), wherein the signal processing unit outputs an output signal including third color information that include the red component, the green component, the blue component, and an additional color component converted from the second input signal based on the second color information, and at least one of luminance and a color display power efficiency of the additional color component is higher than that of a color component represented by the red component, the green component, and the blue component, and the additional color component being different from the red component, the green component, or the blue component.

(7) An image displaying device comprising:

an image display portion including a plurality of pixels, each of the pixels including:

a first sub-pixel for displaying a red component according to an amount of lighting of a self-emitting element;

a second sub-pixel for displaying a green component according to an amount of lighting of a self-emitting element; and a third sub-pixel for displaying a blue component according to an amount of lighting of a self-emitting element, and the image processing device according to (1).

(8) A display device comprising:

an image display portion including a plurality of pixels, each of pixels including:

a first sub-pixel for displaying a red component according to an amount of lighting of a self-emitting element;

a second sub-pixel for displaying a green component according to an amount of lighting of a self-emitting element;

a third sub-pixel for displaying blue color component according to an amount of lighting of a self-emitting element; and a forth sub-pixel for displaying additional color component according to an amount of lighting of a self-emitting element, at least one of luminance and a color display power efficiency of the additional color component is higher than that of a color component represented by the red component, the green component, and the blue component, and the additional color component being different from the red component, the green component, or the blue component; and the image processing device according to (6).

(9) An electronic device comprising:

the display device according to (7); and a controller to control the display device.

(10) A method for processing an image comprising: the converting process which includes receiving a first input signal including first color information, a first color being reproduced at pixels on the basis of the first color information, the first input signal including first color information obtained from an input image signal corresponding to a red component, a green component, a blue component; specifying saturation of the first color; obtaining luminance attenuation ratio on the basis of a relationship previously stored between saturation and luminance attenuation ratio, and the saturation of the first color; outputting a second input signal including second color information whose luminance is decreased from the first color information on the basis of the luminance attenuation ratio corresponding to the first color information; and the signal processing process which includes outputting an output signal for driving the pixels on the basis of the second input signal.

What is claimed is:

1. An image processing device comprising:

a conversion circuitry configured to receive a first input signal including first color information, a first color being reproduced at pixels on a basis of the first color information, the first input signal including the first color information obtained from an input image signal corresponding to a red component, a green component, and a blue component, specify a first saturation of the first color, store a relationship between a saturation and a luminance attenuation ratio, wherein the relationship between the saturation and the luminance attenuation ratio includes the luminance attenuation ratio increasing when the saturation increases from a minimum allowable value to a first saturation value and the luminance attenuation ratio decreasing when the saturation increases from the first saturation value to a maximum allowable value, obtain the luminance attenuation ratio corresponding to the first color information on a basis of the relationship between the saturation and the luminance attenuation ratio and the first saturation of the first color, and output a second input signal including second color information having a luminance that is decreased from the first color information on a basis of the luminance attenuation ratio corresponding to the first color information; and a signal processor configured to obtain the second input signal from the conversion circuitry to output an output signal for driving the pixels on a basis of the second input signal, wherein the first saturation value is a value between the minimum allowable value and the maximum allowable value.

2. The image processing device according to claim 1, wherein the relationship between the saturation and the luminance attenuation ratio further includes the luminance attenuation ratio a value of zero when the saturation is the minimum allowable value and the maximum allowable value.

3. The image processing device according to claim 2, wherein:

a second saturation value is smaller than the first saturation value, and a first increasing rate of the luminance attenuation ratio as the saturation increases from the minimum allowable value to the second saturation value is smaller than a second increasing rate of the luminance attenuation ratio as the saturation increases from the second saturation value to the first saturation value.

4. The image processing device according to claim 2, wherein the first saturation value falls in a range of the saturation equal to and greater than a mean value between the minimum allowable value and the maximum allowable value, and wherein the first saturation value is smaller than the maximum allowable value.

5. The image processing device according to claim 1, wherein the conversion circuitry is further configured to store a second relationship associated with hue region, specify a hue of the first color from the first color information, and obtain the luminance attenuation ratio corresponding to the first color information on a basis of both the first saturation and the hue.

6. The image processing device according to claim 1, wherein the signal processor is further configured to output the output signal including third color information that includes the red component, the green component, the blue component, and an additional color component converted from the second input signal based on the second color information, and wherein at least one of luminance and a color display power efficiency of the additional color component is higher than that of a color component represented by the red component, the green component, and the blue component, and the additional color component being different from the red component, the green component, or the blue component.

7. An image displaying device comprising:

an image display portion including a plurality of pixels, each of the pixels including:

a first sub-pixel for displaying a red component according to an amount of lighting of a first self-emitting element;

a second sub-pixel for displaying a green component according to an amount of lighting of a second self-emitting element; and a third sub-pixel for displaying a blue component according to an amount of lighting of a third self-emitting element, and the image processing device according to claim 1.

8. A display device comprising:

an image display portion including a plurality of pixels, each of pixels including:

a first sub-pixel for displaying a red component according to an amount of lighting of a first self-emitting element;

a second sub-pixel for displaying a green component according to an amount of lighting of a second self-emitting element;

a third sub-pixel for displaying a blue color component according to an amount of lighting of a third self-emitting element; and a forth sub-pixel for displaying additional color component according to an amount of lighting of a fourth self-emitting element, at least one of luminance and a color display power efficiency of the additional color component is higher than that of a color component represented by the red component, the green component, and the blue component, and the additional color component being different from the red component, the green component, or the blue component; and the image processing device according to claim 6.

9. An electronic device comprising:

the display device according to claim 8; and a controller configured to control the display device.

10. A method for processing an image comprising:

receiving, with a conversion circuitry, a first input signal including first color information, a first color being reproduced at pixels on a basis of the first color information, the first input signal including the first color information obtained from an input image signal corresponding to a red component, a green component, and a blue component;

specifying a first saturation of the first color;

storing a relationship between a saturation and a luminance attenuation ratio, wherein the relationship between the saturation and the luminance attenuation ratio includes the luminance attenuation ratio increasing when the saturation increases from a minimum allowable value to a first saturation value and the luminance attenuation ratio decreasing when the saturation increases from the first saturation value to a maximum allowable value;

obtaining the luminance attenuation ratio corresponding to the first color information on a basis of the relationship between the saturation and the luminance attenuation ratio and the first saturation of the first color;

outputting a second input signal including second color information having a luminance that is decreased from the first color information on a basis of the luminance attenuation ratio corresponding to the first color information; and obtaining, with a signal processor, the second input signal from the conversion circuitry to output an output signal for driving the pixels on a basis of the second input signal, wherein the first saturation value is a value between the minimum allowable value and the maximum allowable value.

11. The image processing device according to claim 1, wherein the first color information has a relation that the luminance of the first color decreases as the first saturation of the first color increases, the conversion circuitry is configured to generate, by attenuating the luminance of the first color information with the luminance attenuation ratio, the second input signal such that the luminance of the second color information decreases when a second saturation of the second color information increases from the minimum allowable value to the value between the minimum allowable value and the maximum allowable value, and the luminance of the second color information increases when the second saturation of the second color information increases from the value between the minimum allowable value and the maximum allowable value to the maximum allowable value.

* * * * *